US006324761B1

(12) United States Patent
Mashiko et al.

(10) Patent No.: US 6,324,761 B1
(45) Date of Patent: Dec. 4, 2001

(54) METHOD AND APPARATUS FOR MANUFACTURING A HEADER PIPE

(75) Inventors: Seiji Mashiko; Michito Saito, both of Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/094,494

(22) Filed: Jun. 10, 1998

(30) Foreign Application Priority Data

Jun. 11, 1997 (JP) ..... 9-153393
Jun. 11, 1997 (JP) ..... 9-153395
Jun. 26, 1997 (JP) ..... 9-170319

(51) Int. Cl.[7] ..... B21D 51/38

(52) U.S. Cl. ..... 29/890.52; 29/890.053; 29/890.054

(58) Field of Search ..... 29/890.052, 890.053, 29/509, 513, 890.03, 890.054, 428; 72/379.2

(56) References Cited

U.S. PATENT DOCUMENTS 4,351,175 * 9/1982 Ichikawa et al. ..... 72/203
5,433,138 * 7/1995 Choinski et al. ..... 29/509
5,720,144 * 2/1998 Knudson et al. ..... 29/509
5,765,634 * 6/1998 Martins ..... 29/890.053
5,799,397 * 9/1998 Yasuda et al. ..... 29/890.052
5,875,668 * 3/1999 Kobayashi et al. ..... 29/890.053
5,996,205 * 12/1999 Mashiko et al. ..... 29/890.052
6,049,981 * 4/2000 Mashiko ..... 29/890.052

* cited by examiner

*Primary Examiner*—Irene Cuda Rosenbaum
*Assistant Examiner*—T. Nguyen

(57) ABSTRACT

The end faces of the edge portions of a flat plate, which have been respectively cut into a given shape according to a trimming operation, are then respectively face-struck into a linear shape. Also, in the trimming operation, each of the edge portions of the flat plate is cut into a shape having a larger dimension than that of a finally required shape thereof, and the thus produced excess length portions of the edge portions are worked by compressing when a pair of semidivided cylindrical portions are butted against each other. Since a connecting portion situated between the pair of semidivided cylindrical portions is always pressed with a given pressure, the working properties of the connecting portion in the molding operation are prevented from being revived. Further, in the neighborhood of one side edge portion and the other side edge portion, there are formed pressing recessed portions or pressing projecting portions which, when connecting together one side edge portion and the other side edge portion, are used to press against one side edge portion and the other side edge portion in their mutually opposing directions.

3 Claims, 32 Drawing Sheets

METHOD AND APPARATUS FOR MANUFACTURING A HEADER PIPE

BACKGROUND OF THE INVENTION

1. Field of the Invention

The present invention relates to a header pipe to be used as a tank in a heat exchanger, a method for manufacturing the header pipe, and an apparatus for manufacturing the header pipe.

2. Description of the Related Art

Conventionally, in a heat exchanger such as a capacitor for use in a car or the like, for example, as disclosed in Japanese Utility Model Publication No. Hei. 4-63982, a partition is provided in a header to thereby change the flow passage of fluid.

And, conventionally, this type of header with a partition for use in a heat exchanger is manufactured in the following manner as shown in FIG. 36.

At first, an aluminum alloy pipe member with a brazing member clad on the outer surface thereof is cut to a given size to thereby obtain a pipe 11 which can be used in a header.

After then, in the pipe 11, there are formed a plurality of tube insertion holes 13, a slit for a divide 15, a fluid flow-in port 17, and a fluid flow-out port 19.

Next, an aluminum alloy divide 21 with brazing members clad on the two surfaces thereof is inserted into the slit for a divide 15, and also two aluminum alloy patches 23 are respectively pressure inserted into the two end portions of the pipe 11.

However, in the thus structured header with a partition for use in a heat exchanger, since there is used an expensive pipe member which has been previously formed in a cylindrical shape, the material cost thereof is high.

Also, there is a fear that a poor brazed condition can occur between the pipe 11 and divide 21.

Conventionally, as a method which has solved these problems, there is known a method for manufacturing a pipe with a partition which is disclosed in Japanese Patent Publication No. Hei. 7-314035 previously applied by the present applicants.

In this method for manufacturing a pipe with a partition, as shown in FIGS. 37 and 38, there is manufactured a pipe with a partition structured such that a partition portion 33 comprising a pair of semidivided partition portions 32 is formed in the central portion of a cylindrical-shaped pipe portion 31 thereof.

And, the present pipe with a partition can be manufactured in the following manner:

That is, at first, in a molding step shown in FIG. 39, a plate member formed of aluminum is molded in such a manner that a pair of semidivided cylindrical portions 35 are formed.

The pair of semidivided cylindrical portions 35 are arranged in parallel to each other with an arc-shaped connecting portion 37 between them.

And, each of the paired semidivided cylindrical portions 35 includes a partition forming portion 39 which projects inwardly in a U-shape manner.

Also, each of the paired semidivided cylindrical portions 35 is smaller by 2 mm or so in radius than a pipe portion 31 to be formed, while each semidivided cylindrical portion 35 further includes an edge portion 41 on the outside thereof.

The above-mentioned molding step is carried out by holding the aluminum flat plate between a given pair of metal molds and then molding the flat plate by pressing.

Next, in a cutting step shown in FIG. 40, a portion A of the connecting portion 37 situated between the partition forming portions 39 shown by oblique lines in FIG. 40 as well as the edge portions 41 respectively situated on the two sides of the partition portions 39 are cut and removed together with the excessively increased thickness portions 41*a* of the edge portions 41.

This cutting step is executed by trimming and piercing the press worked plate using a piece of press work machinery.

After then, in a compressing step shown in FIG. 41, the partition forming portion 39 is compressed from both sides thereof to thereby form a semidivided partition portion 32.

This compressing step is carried out in such a manner as shown in FIG. 42: that is, the outside portions of the semidivided cylindrical portions 35 are respectively held by a work holder 51 which is energized by springs 49 and, on the other hand, two compressing members 53 are respectively disposed on the two sides of the partition forming portion 39 located inwardly of the semidivided cylindrical portions 35, whereby the partition forming portion 39 is compressed in the direction of arrows B and molded by the compressing members 53.

In this compression molding operation, between the compressing members 53, there is interposed a dimension correcting block 55; that is, the inwardly projecting length H of the semidivided partition portion 32 can be corrected by the dimension correcting block 55.

Next, in an edge portion molding step shown in FIG. 43, the two edge portions 41 situated on the two sides of the pair of semidivided cylindrical portions 35 are molded, and the edge portions 41 are formed in an arc-shaped manner; that is, the edge portions 41 are so formed as to continue with their respective semidivided cylindrical portions 35 in an arc-shape manner.

This edge portion molding step is carried out by holding the pair of semidivided cylindrical portions 35 between a given metal molds and then molding them by pressing.

After then, according to a mutually opposing step shown in FIG. 44, the connecting portion 37 is projected from the inside thereof to thereby allow the pair of semidivided cylindrical portions 35 to be disposed in such a manner that they are opposed to each other.

In particular, this mutually opposing step is carried out by storing the outside portions of the semidivided cylindrical portions 35 into a metal mold 57 and then pressing the connecting portion 37 against the arc portion 61 of the metal mold 57 by a punch 59.

Next, according to a butting step shown in FIG. 45, the pair of mutually opposed semidivided cylindrical portions 35 are butted against each other.

This butting step can be carried out by storing the outside portions of the semidivided cylindrical portions 35 into a metal mold (not shown) and then moving the metal mold. In this step, the semidivided cylindrical portions 35 are molded into a pipe shape.

After then, a connecting step is carried out: that is, not only the pair of semidivided cylindrical portions 35 but also the pair of semidivided partition portions are connected to each other, thereby manufacturing a pipe with a partition which is shown in FIGS. 46 and 47.

The connecting step can be achieved, for example, by executing a brazing operation using non-corrosive flux.

Now, FIG. 46 shows a header with a partition for use in a heat exchanger manufactured in the above-mentioned conventional method for manufacturing a pipe with a partition; and, the present header with a partition for a heat exchanger includes a partition portion 33 formed in the central portion of a cylindrically-shaped pipe portion 31A thereof.

Also, on one side of the outer periphery of the pipe portion 31A, there are formed tube insertion holes 63 which are spaced from each other at given intervals.

Further, the openings of the pipe portion 31A, which are respectively formed in the two ends of the pipe portion 31A, are closed by cover members 65 respectively.

In the present method for manufacturing a header with a partition for a heat exchanger, after completion of the edge portion molding step shown in FIG. 43, as shown in FIG. 47, the tube insertion holes 63 are formed in one of the semidivided cylindrical portions 35 at given intervals and, at the same time, there are formed a fluid flow-in port 67, into which a thermal medium is allowed to flow, and a fluid flow-out portion 69 from which the thermal medium is allowed to flow out.

This step can be carried out by slit-pierce molding the semidivided cylindrical portion 35 using a piece of press work machinery.

In the thus manufactured header with a partition for use in a heat exchanger, since a single piece of plate member can be molded easily into a pipe portion 31A having a partition portion 33 formed integrally therewith, there is eliminated the need for use of an expensive pipe member which has been previously formed into a cylindrical shape. This makes it possible to reduce the material cost thereof greatly when compared with the previously cited conventional header.

Also, with use of the present header with a partition for use in a heat exchanger, when compared with the method in which a pipe is manufactured in a cylindrical shape, since the partition portion thereof is formed integrally with the pipe portion thereof, the number of parts used can be decreased to thereby be able to reduce the cost of the header.

Further, because the tube insertion hole 63 can be worked in a semicircle condition, a mold used to mold the tube insertion hole 63 can be made sufficiently strong, the working time of the tube insertion holes 63 can be shortened, and thus the cost of the header can also be reduced.

Also, since the pair of semidivided cylindrical portions 35 and the pair of semidivided partition portions 32 can be connected to each other positively by brazing, it is possible to surely prevent the thermal medium from leaking externally from the partition portion 33.

Next, another example of a method for manufacturing a pipe member, especially focused on the method for connecting edge portions of the cylindrical portions will be described. The pipe member according to the above method is manufactured in such a manner that, as shown in FIG. 50, a plate member 311 is molded into a cylindrical-shaped member and, after then, one side edge portion 311*a* of the cylindrical-shaped member and the other side edge portion 311*b* thereof are connected together by brazing R.

However, in such conventional pipe member 313, if the pipe member 313 is heated up to a high temperature within a brazing furnace for the purpose of brazing, then, as shown in FIG. 51, with a point C as the center thereof, one side edge portion 311*a* and the other side edge portion 311*b* are opened, which makes it difficult to braze together one side edge portion 311*a* and the other side edge portion 311*b* with accuracy.

In view of this, conventionally, as shown in FIG. 52, there is employed a method in which one side edge portion 311*a* and the other side edge portion 311*b* of the pipe member 313 are previously spot welded W together at intervals and, after then, one side edge portion 311*a* and the other side edge portion 311*b* are brazed to each other.

However, in the above-mentioned conventional manufacturing method, because one side edge portion 311*a* and the other side edge portion 311*b* of the pipe member 313 are previously spot welded W together at intervals, there arises a problem that a large number of man-hours are necessary to manufacture the pipe member 313.

Conventionally, as a method which has solved this problem, there are known a pipe and a method for manufacturing the same.

FIGS. 53 and 55 respectively show a pipe which adopts such method. This pipe is used as a tank for a heat exchanger such as a capacitor or the like and includes a pipe main body 321 on one side of which there is formed a partition portion 323 used to partition the passage of a refrigerant.

The pipe main body 321 is formed in a cylindrical shape, while two patch ends 325 each formed of aluminum are respectively fitted with and brazed to the two sides of the pipe main body 321.

One side edge portion 327 and the other side edge portion 329 of the pipe main body 321, as shown in FIG. 55, are brazed R to each other.

And, as shown in FIG. 54, in the longitudinal direction of the pipe main body 321, there are provided a plurality of fitting portions 331 which are spaced at intervals from one another.

Each of the fitting portions 331, as shown in FIG. 53, includes a securing portion 333 to be formed integrally with one side edge portion 327 of the pipe main body 321, and a caulking pawl portion 335 to be formed integrally with the other side edge portion 329 of the pipe main body 321.

And, the leading end portion 335*a* of the caulking pawl portion 335 is stored in a securing recessed portion 337 which is formed in the pipe main body 321.

Now, the above-mentioned pipe is manufactured in the following manner.

That is, at first, according to a molding step shown in FIG. 56, a flat plate formed of aluminum is molded to thereby form a pair of semicircular-shaped semidivided cylindrical portions 339.

The pair of semidivided cylindrical portions 339 are arranged in parallel to each other with an arc-shaped connecting portion 341 between them.

And, at the same time when the pair of semidivided cylindrical portions 339 are formed, in the respective edge portions of the pair of semidivided cylindrical portions 339, there are also formed flat portions 343 which project outwardly.

Also, at the same time when the pair of semidivided cylindrical portions 339 are formed, on the edge portion side of one of the pair of semidivided cylindrical portions 339, there is formed a securing recessed portion 337.

The above-mentioned molding step is executed by holding the flat plate between given metal molds and then molding the same by pressing.

Next, according to a bending step shown in FIG. 57, the flat portion 343 is bent in the opening direction of the semidivided cylindrical portion 339 being in a direction of the arrow C to thereby form a flange portion 345.

After then, according to a cutting step shown in FIG. 58, the flange portion 345 is cut and removed while the portion thereof corresponding to the securing recessed portion 337 is left, that is, the portions of the flange portion 345 shown by oblique lines in FIG. 58 are cut and removed; and, on the securing recessed portion 337 side, there is formed the securing portion 333.

Also, on the opposite side of the securing recessed portion 337, there is formed a caulking pawl portion forming portion 347.

This cutting step can be achieved by trimming the flat plate using a piece of press work machinery.

Next, according to a caulking pawl portion molding step shown in FIG. 59, the caulking pawl portion forming portion 347 is pushed outwardly by an amount correspond to the thickness of the flat plate to thereby form the-caulking pawl portion 335.

After then, according to a mutually opposing step shown in FIG. 60, the connecting portion 341 is projected from the inside thereof to thereby dispose the pair of semidivided cylindrical portions 339 in such a manner that they are substantially opposed to each other.

This mutually opposing step can be attained by storing the pair of semidivided cylindrical portions 339 into a metal mold (not shown) and then pressing the connecting portion 341 against the arc-shaped portion of the metal mold using a punch.

Finally, according to a curling step shown in FIG. 61, the pair of substantially opposed semidivided cylindrical portions 339 are butted against each other and, at the same time, the caulking pawl portion 335 is bent along the outside portion of the securing portion 333, so that the caulking pawl portion 335 is fitted with the securing portion 333.

This curling step is carried out in the following manner: that is, a pipe member 351 formed in such a manner as shown in FIG. 61 is stored in a pair of mutually opposed metal molds 353 and then the metal molds 353 are moved.

In both of the two metal molds 353, there are formed semicircular-shaped arc portions 355 and, in the edge portion of one of the metal molds 353, there is formed a curling portion 357.

And, curling can be achieved by moving both of the metal molds 353 at an angle of, for example, 10 degree, as shown by arrows D in FIG. 61.

That is, as shown in FIG. 62, after the leading end of the caulking pawl portion 335 is contacted with the wall portion 359 of the curling portion 357, if the metal molds 353 are closed further, then the caulking pawl portion 335 is curled along the securing portion 333, so that the caulking pawl portion 335 is fitted with the securing portion 333.

After then, according to a brazing step, not only one side edge portion 327 and the other side edge portion 329 are brazed to each other but also the securing portion 333 and caulking pawl portion 335 are brazed to each other.

This brazing step can be achieved in the following manner: that is, for example, non-corrosive flux is applied onto the brazing portions and, after then, the brazing portions are thermally treated in the nitrogen ambient condition.

With use of the pipe structured in the above-mentioned manner, if the securing portion 333 formed integrally with one side edge portion 327 of the pipe main body 321 is fitted with the caulking pawl portion 335 formed integrally with the other side edge portion 329 of the pipe main body 321, then one side edge portion 327 and the other side edge portion 329 can be positively contacted with each other at a given position; that is, without using spot welding or the like, one side edge portion 327 and the other side edge portion 329 can be positively connected with each other at a given position.

Also, since the leading end of the caulking pawl portion 335 is stored in the securing recessed portion 337 formed in the pipe main body 321, the caulking pawl portion 335 is prevented from projecting, which makes it possible to obtain a pipe which is free from troublesome projecting portions.

Further, in the above pipe, due to the fitting engagement between the securing portion 333 and caulking pawl portion 335, one side edge portion 327 and the other side edge portion 329 are positively contacted with each other at a given position, and such contact can be kept even if the temperature rises. Therefore, not only one side edge portion 327 and the other side edge portion 329 can be positively brazed to each other but also the securing portion 333 and caulking pawl portion 335 can be positively brazed to each other.

However, according to one of the above-mentioned conventional methods for manufacturing a header pipe with a partition for use in a heat exchanger, in the cutting step shown in FIG. 40, when the edge portions 41 respectively situated on the two sides of the partition forming portions 39 are cut and removed together with the excessively increased thickness portions 41*a* by trimming, then, as shown in FIG. 48, in each of the edge portions 41, there are produced loosened portions 41*c* and 41*d* in a trimmed or cut surface 41*b* thereof, so that the length of a linear portion 41*e* thereof is reduced. That is, when the pair of semidivided cylindrical portions 35 are butted against each other and are then brazed together, it is difficult to obtain a sufficient brazing strength, which in turn makes it difficult to secure a given cutting strength which is required of a header pipe.

By the way, the above-mentioned problem can also be solved by previously increasing the thickness of a flat plate serving as a blank material in consideration of production of the loosened portions 41*c* and 41*d*. However, in this case, there arises another problem that the material cost of the header pipe increases.

Further, in the butting step shown in FIG. 45, when the pair of semidivided cylindrical portions 35 are pressed and butted against each other by a pair of metal molds, as shown in FIG. 49, not only there are formed hollows 68 respectively on the two sides of the portion that was the connecting portion 37 in the mutually opposing step shown in FIG. 44, but also there is formed a projecting portion 70 in the central portion of the portion that was the connecting portion 37.

That is, when the two sides of the portion that was the connecting portion 37 are hollowed and, at the same time, the central portion of the portion that was the connecting portion 37 is projected, it is difficult to braze a pipe laying connector, a mounting bracket and the like in a positive manner.

The present inventors have studied deliberately the above-mentioned problem in order to solve the same. Our study has found why the two sides of the portion that was the connecting portion 37 are hollowed and, at the same time, the central portion of the portion that was the connecting portion 37 is projected; that is, the reason of occurrence of such hollows and projecting portion is that the molding or working properties of the connecting portion 37 in the molding step shown in FIG. 39 are revived.

Further, also in another of the above-mentioned conventional pipe manufacturing methods, there is still found a problem. That is, when the pair of mutually opposed semidivided cylindrical portions 339 are butted against each other to thereby mold them into a pipe shape in the curling step shown in FIG. 61, the outside surfaces of the semidivided cylindrical portions 339 are mainly pressed by the metal molds 353. At this time, it is impossible to dispose any member to regulate the position of the pair of mutually opposed semidivided cylindrical portions 339, therefore, it can be rotated in the metal molds 353. So there is possibility that the tip end of the caulking pawl portion 349 which is positioned closest to the opposed metal mold 353 is caused to collide with the outside portion of the metal mold 353 which is located outside of the actual working portion of the caulking pawl portion 349 in the metal mold 353, so the caulking pawl portion 349 is deformed outward. By this deformation, there is occurred a problem that the peripheral portion of the deformed caulking pawl portion 349 in the pipe is also deformed, or it becomes impossible to caulk the caulking pawl portion 349 to the securing recessed portion 337.

SUMMARY OF THE INVENTION

The present invention aims at eliminating the above-mentioned problems found in the conventional header pipe manufacturing method. Accordingly, it is an object of the invention to provide a method for manufacturing a header pipe in which, without increasing the thickness of a flat plate used as a blank material, the butted portions of a pair of semidivided cylindrical portions can be brazed together with a high strength.

Further, it is another object of the invention to provide an apparatus which is able to positively butt work a pair of semidivided cylindrical portions disposed on the two sides of a connecting portion and opposed to each other at a given angle interval to thereby manufacture a cylindrically-shaped header pipe.

Accordingly, still further, it is still another object of the invention to provide a pipe in which, even when a caulking pawl portion is formed, one side edge portion and the other side edge portion of a pipe main body can be positively connected with each other, and a method for manufacturing the same.

According to a first aspect of the invention, there is provided a method for manufacturing a header pipe, comprising the steps of: molding a flat plate so that a pair of semidivided cylindrical portions are formed in parallel to each other with a connecting portion therebetween; cutting edge portions of said flat plate respectively into a given shape; striking end faces of said edge portions of said flat plate respectively so as to work into a linear shape; projecting said connecting portion so as to dispose said pair of semidivided cylindrical portions being opposed to each other; and butting said pair of mutually opposed semidivided cylindrical portions against each other to thereby manufacture a cylindrically-shaped header pipe.

The end faces of the edge portions of the flat plate respectively cut into a given shape by trimming are respectively worked into a linear shape by face-striking, so that the mutually butted portions of the pair of semidivided cylindrical portions are formed into a linear shape.

According to a second aspect of the invention, there is provided a method for manufacturing a header pipe, comprising the steps of: molding a flat plate so that a pair of semidivided cylindrical portions are formed in parallel to each other with a connecting portion therebetween; cutting edge portions of said flat plate respectively into a given shape so that excess portions are remained in said edge portions; projecting said connecting portion so as to dispose said pair of semidivided cylindrical portions being opposed to each other; and butting said pair of mutually opposed semidivided cylindrical portions against each other while compressing said excess portions to thereby manufacture a cylindrically-shaped header pipe.

In the trimming operation, the edge portions of the flat plate are respectively cut into a shape having a larger dimension than that of the finally required shape thereof, and the excess length portions of the edge portions are compressed when the pair of semidivided cylindrical portions are butted against each other, so that the mutually butted portions can be connected together substantially in a linear shape.

According to a third aspect of the invention, there is provided an apparatus for manufacturing a header pipe, the apparatus working a pair of semidivided cylindrical portions respectively arranged on both sides of a connecting portion and opposed to each other at a given angle interval to thereby manufacture a cylindrically-shaped header pipe, said apparatus comprising:a lifter for supporting said connecting portion; energizing means for energizing said lifter toward said connecting portion; a pair of punches respectively disposed rotatably on both sides of said lifter and respectively including semicircular-shaped butting recessed portions which can be fitted with outer peripheries of said pair of semidivided cylindrical portions; and pressing means for moving said pair of punches toward said pair of semidivided cylindrical portions and rotating said pair of punches so as to reduce the given angle interval thereby butting said pair of semidivided cylindrical portions with each other.

While the pair of semidivided cylindrical portions disposed on the two sides of the connecting portion and opposed to each other at a given angle interval are placed on the lifter, the pressing means is operated to thereby move the punches toward the semidivided cylindrical portions. Due to this movement of the punches, the butting recessed portions of the punches, which are respectively disposed on the two sides of the lifter, are respectively fitted with the outer peripheries of the pair of semidivided cylindrical portions. After then, if the punches are rotated by the pressing means, then the pair of semidivided cylindrical portions are butted against each other.

At the then time, since the connecting portion situated between the pair of semidivided cylindrical portions is always pressed with a given pressure by the energizing means through the lifter, the working properties of the connecting portion in the molding operation thereof are prevented from being revived.

Also, the lifter pressing lever is rotated together with the punches and the lifter is thereby pressed against the energizing force of the energizing means, which makes it possible to restrict the pressing force acting on the connecting portion.

Further, the movement of the lifter is stopped at the lower dead point of the pressing means by the stopper means, which prevents the butted portions of the pair of semidivided cylindrical portions from being deformed by the further rotation of the punches exceeding the dead point.

According to a fourth aspect of the invention, there is provided a method for manufacturing a header pipe, comprising the steps of: molding a flat plate so that a pair of semidivided cylindrical portions are formed in parallel to each other with a connecting portion therebetween; forming a securing portion at a first edge portion of said flat plate; forming a caulking pawl portion at a second edge portion of said flat plate; forming retaining portions respectively adjacent to said first and second edge portions, said retaining portions being retained by pressing portions provided respectively in a pair of molds; projecting said connecting portion so as to dispose said pair of semidivided cylindrical portions being opposed to each other; setting said pair of semidivided cylindrical portions in the pair of molds while retaining said retaining portions to the pressing portions provided in said pair of molds respectively; moving said molds in mutually opposing direction thereof so as to press against said first edge portion and said second edge portion; and caulking said caulking pawl portion to said securing portions to thereby form a header pipe.

While the pressing portions formed in the metal molds are being secured to the pressing recessed portions or the pressing projecting portions as the retaining portion respectively formed in the neighborhood of one side edge portion and the other side edge portion of a pipe main body, the metal molds are moved to thereby press one side edge portion and the other side edge portion in their mutually opposing directions, so that one side edge portion and the other side edge portion are connected to each other.

DETAILED DESCRIPTION OF THE PREFERRED EMBODIMENTS

Now, description will be given below of the preferred embodiments of a method and an apparatus for manufacturing a header pipe according to the invention with reference to the accompanying drawings.

Figure 2:
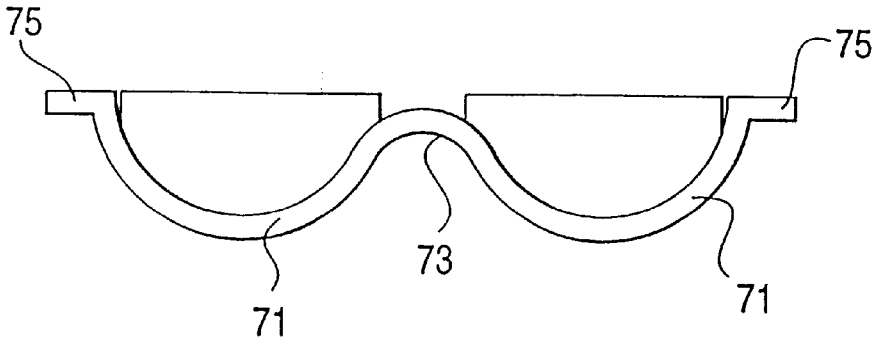
FIG. 2 is an explanatory view of the embodiment of a method for manufacturing a header pipe according to the invention, showing a state thereof after a molding step thereof is completed.

In an embodiment employed in a method for manufacturing a header pipe according to the invention, as shown in FIG. 2, by molding a flat plate formed of aluminum, a pair of semidivided cylindrical portions 71 are formed in parallel to each other with an arc-shaped connecting portion 73 between them.

Figure 3:
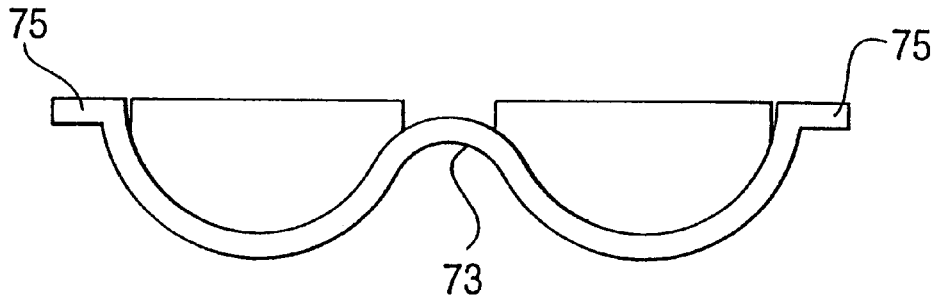
FIG. 3 is an explanatory view of the embodiment of a method for manufacturing a header pipe according to the invention, showing a state thereof after a cutting step thereof is completed.

After then, as shown in FIG. 3, according to a cutting step, the edge portions 75 of the flat plate are respectively cut into a given shape by trimming.

Figure 4:
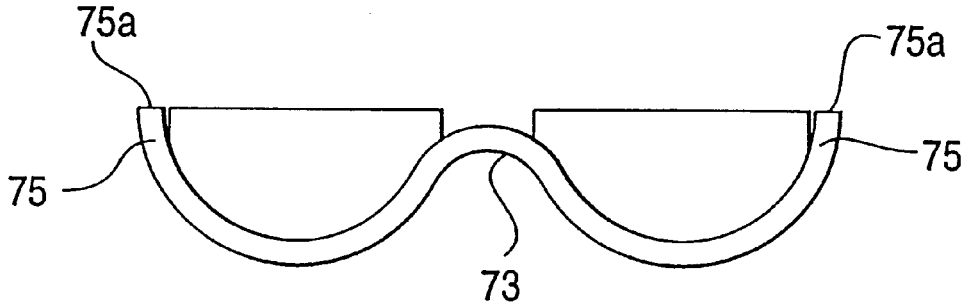
FIG. 4 is an explanatory view of the embodiment of a method for manufacturing a header pipe according to the invention, showing a state thereof after an edge portion molding step thereof is completed.

After completion of the cutting step, as shown in FIG. 4, according to an edge portion molding step, the edge portions 75 of the flat plate are respectively made erect.

Next, the end faces 75*a* of the edge portions 75 of the flat plate, which have been respectively cut into the given shape according to the trimming operation, are respectively face-struck into a linear shape.

Figure 1:
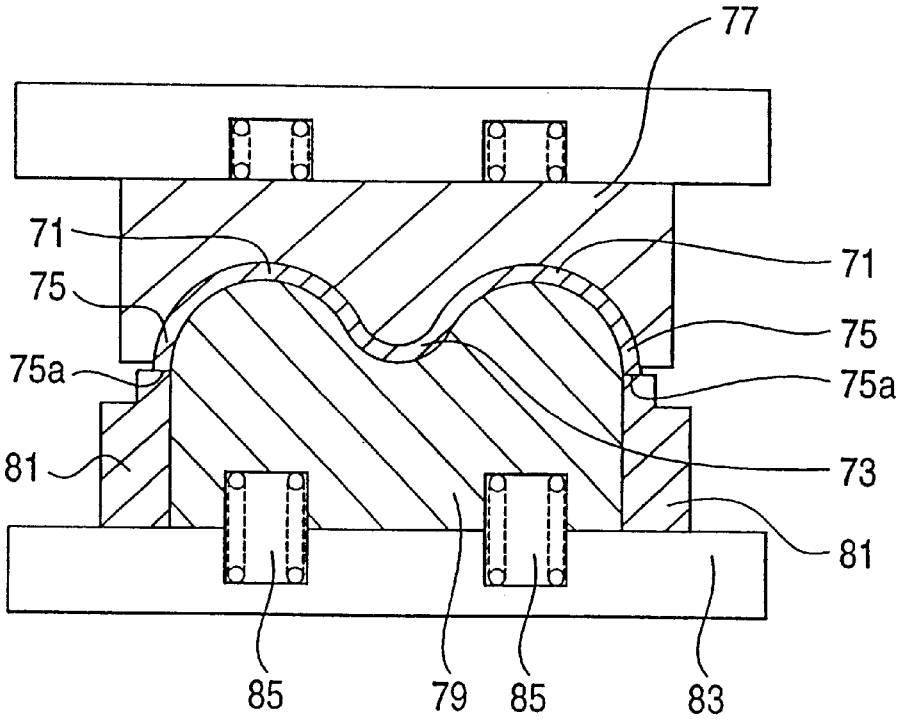
FIG. 1 is an explanatory view of a restriking step employed in an embodiment of a method for manufacturing a header pipe according to the invention.

This face-striking operation can be achieved in such a manner as shown in FIG. 1: that is, the semidivided cylindrical portions 71 and the connecting portion 73 are held by and between a pad 77 and a floating punch 79, and the end faces 75*a* of the edge portions 75 are pressed against punches 81 respectively.

By the way, the floating punch 79 and punches 81 are respectively placed on a base 83, while the floating punch 79 is energized toward the pad 77 by springs 85.

Figure 5:
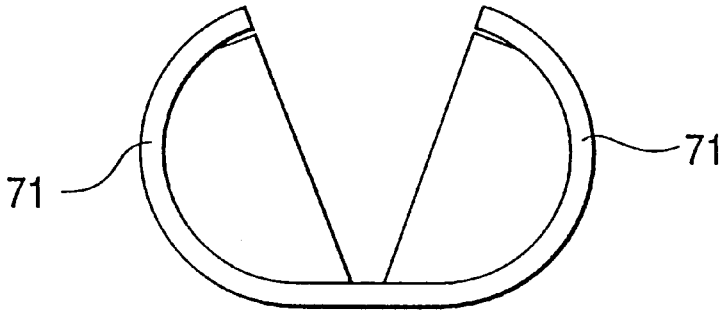
FIG. 5 is an explanatory view of the embodiment of a method for manufacturing a header pipe according to the invention, showing a state thereof after a mutually opposing step thereof is completed.

After completion of the face-striking operation, according to a mutually opposing step, as shown in FIG. 5, the connecting portion 73 is projected from the inside thereof to thereby dispose the pair of semidivided cylindrical portions 71 in such a manner that they are opposed to each other at an interval of a certain angle, for example, 30 degree.

Figure 6:
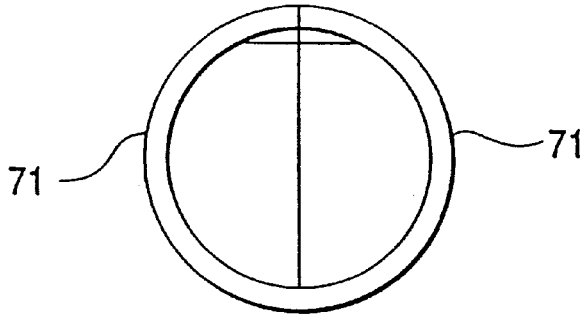
FIG. 6 is an explanatory view of the embodiment of a method for manufacturing a header pipe according to the invention, showing a state thereof after a butting step thereof is completed.

Next, as shown in FIG. 6, according to a butting step, the pair of mutually opposed semidivided cylindrical portions 71 are butted against each other.

According to the above-mentioned method for manufacturing a header pipe, the end faces 75*a* of the edge portions 75 of the flat plate, which have been respectively cut into the given shape according to the trimming operation, are respectively face-struck into a linear shape and the mutually butted portions of the pair of semidivided cylindrical portions 71 are formed into a linear shape. With use of this process, since the mutually butted portions of the pair of semidivided cylindrical portions 71 are opposed to each other with a slight distance between them when the pair of semidivided cylindrical portions 71 are butted against each other, the mutually butted portions of the pair of semidivided cylindrical portions 71 can be brazed together with a high strength without increasing the thickness of the flat plate used as a blank material.

Now, in another embodiment of a method for manufacturing a header pipe according to the invention, in the trimming operation in the above-mentioned cutting step, each of the edge portions 75 of the flat plate is cut into a shape having a larger dimension than that of a finally required shape thereof.

Figure 7:
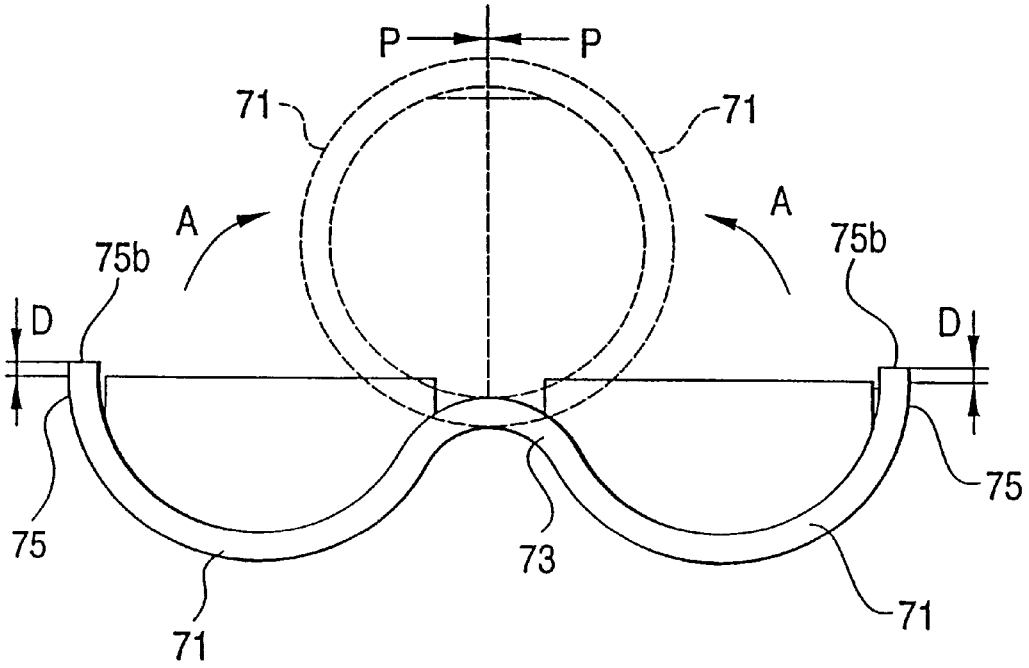
FIG. 7 is an explanatory view of the main portions of another embodiment of a method for manufacturing a header pipe according to the invention.

For this reason, at the time when the above-mentioned edge molding step is completed, as shown in FIG. 7, there are produced excess length portions 75*b* each having a slight length D in the respective edge portions 75 of the semidivided cylindrical portions 71.

And, the thus produced excess length portions 75*b,* when the pair of semidivided cylindrical portions 71 are butted against each other in the direction of arrows A, are compressed with a given pressure P to be thereby deformed plastically with respect to each other, so that they can be contacted with each other substantially in a linear condition.

That is, in the header pipe manufacturing method according to the above embodiment, due to the fact that, in the trimming operation, each of the edge portions 75 of the flat plate is cut into a shape having a larger dimension than that of a finally required shape thereof and the thus produced excess length portions 75*b* are compressed with a given pressure P when the pair of semidivided cylindrical portions 71 are butted against each other, the mutually butted portions of the pair of semidivided cylindrical portions 71 can be contacted with each other substantially in a linear condition. This makes it possible to braze the mutually butted portions of the pair of semidivided cylindrical portions 71 to each other with a high strength without increasing the thickness of the flat plate used as a blank material.

Figure 8:
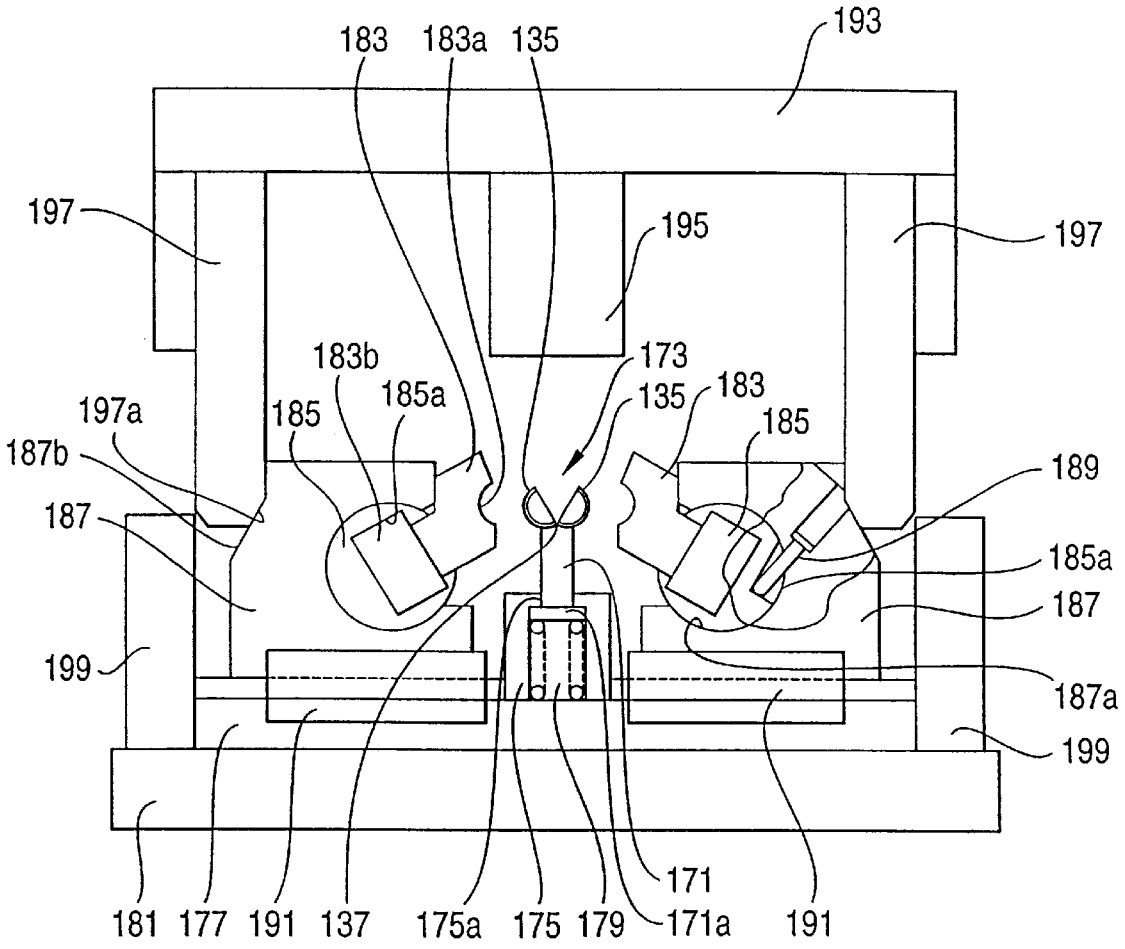
FIG. 8 is a front view of an embodiment of a header pipe cylindrical work apparatus according to the invention, showing a state thereof before it starts its working operation.
Figure 9:
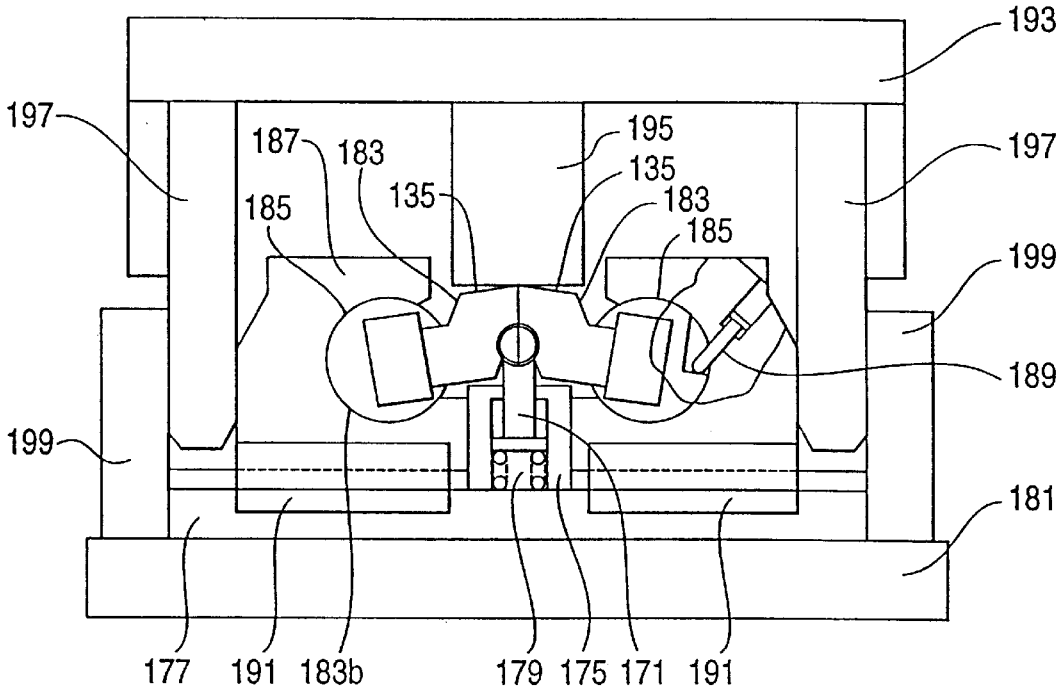
FIG. 9 is a front view of the header pipe cylindrical work apparatus shown in FIG. 8, showing a state thereof after it has finished its working operation.

Next, description will be given below of the other embodiments of a method and an apparatus for manufacturing a header pipe. FIGS. 8 and 9 respectively show a header pipe cylindrical work apparatus according to the present embodiment. In these figures, reference character 171 designates a lifter on which a workpiece 173 can be placed.

In the present embodiment, the workpiece 173 is structured in such a manner that a pair of semidivided cylindrical portions 135 which are disposed on the two sides of a connecting portion 137 and opposed to each other at a given angle interval.

The lifter 171 is stored in a hold member 175 in such a manner that it can be moved freely in the vertical direction.

The lifter 171 includes a flange portion 171*a* in the lower end portion thereof; that is, if the flange portion 171*a* is contacted with an inside flange 175*a* formed in the upper end portion of the hold member 175, then the lifter 171 is prevented from being removed from the hold member 175.

The lower end of the hold member 175 is fixed to a base member 177 and, between the base member 177 and the flange portion 171*a* of the lifter 171, there are provided a plurality of coil springs 179 serving as energizing means for energizing the lifter 171 upwardly, while the coil springs 179 are disposed at given intervals in the longitudinal direction of the lifter 171.

The base member 177 is fixed to a lower holder 181.

On both sides of the lifter 171, there are disposed a pair of punches 183 in such a manner that they are free to rotate.

Each of the punches 183 includes a semicircular butting recessed portion 183*a* which can be fitted with the outer periphery of its associated semidivided cylindrical portion 135.

The punch 183 also includes a rectangular-shaped support portion 183*b* in the rear end portion thereof and the support portion 183*b* is fitted with and fixed to a rectangular-shaped recessed portion 185*a* formed in a rotary shaft 185.

The rotary shaft 185 is rotatably supported in an arc-shaped recessed portion 187*a* formed in each of a pair of cam slides 187 which are respectively disposed on both sides of the lifter 171.

In the rotary shaft 185, there is formed a cut groove 185*a;* that is, if the cut groove 185*a* is energized by a plunger 189 (attached to each punch 183), then the pair of punches 183 can be held in their open conditions.

Each of the cam slides 187 is structured in such a manner that it is free to move in the horizontal direction along its associated guide member 191 and, normally, the cam slide 187 is energized outwardly by an energizing mechanism (not shown).

The two guide members 191 are respectively fixed to the base member 177.

Upwardly of the lower holder 181, there is disposed an upper holder 193 which is used as pressing means.

In the central portion of the upper holder 193, in particular, at a position which is situated above the lifter 171, there is disposed a block member 195 which is used to press the pair of punches 183 downwardly.

Also, on both sides of the upper holder 193, there are disposed a pair of cam drivers 197.

The two cam drivers 197 are disposed in such a manner that they can be respectively inserted between backup heels 199, which are respectively arranged on both sides of the lower holder 181, and the cam slides 187.

Each of the cam drivers 197 includes a cam surface 197*a* which can be contacted with the cam surface 187*b* of its associated cam slide 187.

In the above-mentioned header pipe cylindrical work apparatus, the butting operation of the pair of semidivided cylindrical portions 135 is carried out in the following manner.

That is, at first, as shown in FIG. 8, the cam surfaces 197*a* of the cam drivers 197 are respectively contacted with the cam surfaces 187*b* of the cam slides 187. Also, while the pair of punches 183 are opened by the plungers 189, onto the upper surface of the lifter 171, there is placed the workpiece 173 in which the pair of semidivided cylindrical portions 135 are disposed on the two sides of the connecting portion 137 and opposed to each other at a given angle interval.

By the way, in this state, the block member 195 of the upper holder 193 is spaced sufficiently from the pair of punches 183, while the pair of cam slides 187 are spaced sufficiently from each other.

From this state, if the upper holder 193 serving as the pressing means is moved downward, then the cam surfaces 187*b* of the cam slides 187 are pressed by the cam surfaces 197*a* of the cam drivers 197, so that the pair of cam slides 187 are moved in their mutually opposing directions and the cam surfaces 197*a* of the cam drivers 197 are thereby removed from the cam surfaces 187*b* of the cam slides 187 respectively; and, if the cam drivers 197 are situated perfectly between the cam slides 187 and the backup heels 199, then the butting recessed portions 183*a* of the punches 183 rotatably disposed on both sides of the lifter 171 are respectively fitted with the outer peripheries of the pair of semidivided cylindrical portions 135.

And, in this state, the block member 195 of the upper holder 193 is in contact with the upper ends of the pair of punches 183 and, from this state, if the upper holder 193 is moved downward, then the pair of punches 183 are rotated; that is, due to this rotation, as shown in FIG. 9, the pair of semidivided cylindrical portions 135 are butted against each other.

At the then time, since the connecting portion 137 situated between the pair of semidivided cylindrical portions 135 is always pressed with a given pressure by the coil springs 179 through the lifter 171, the working properties of the connecting portion 137 in the molding operation are prevented from being revived.

In the above structured header pipe cylindrical work apparatus, as described above, the connecting portion 137 situated between the pair of semidivided cylindrical portions 135 is always pressed with a given pressure by the coil springs 179 through the lifter 171, the working properties of the connecting portion 137 in the molding operation are prevented from being revived. Thanks to this, the pair of semidivided cylindrical portions 135, which are disposed on the two sides of the connecting portion 137 and opposed to each other at a given angle interval, can be butt worked into a cylindrical shape with accuracy.

Figure 10:
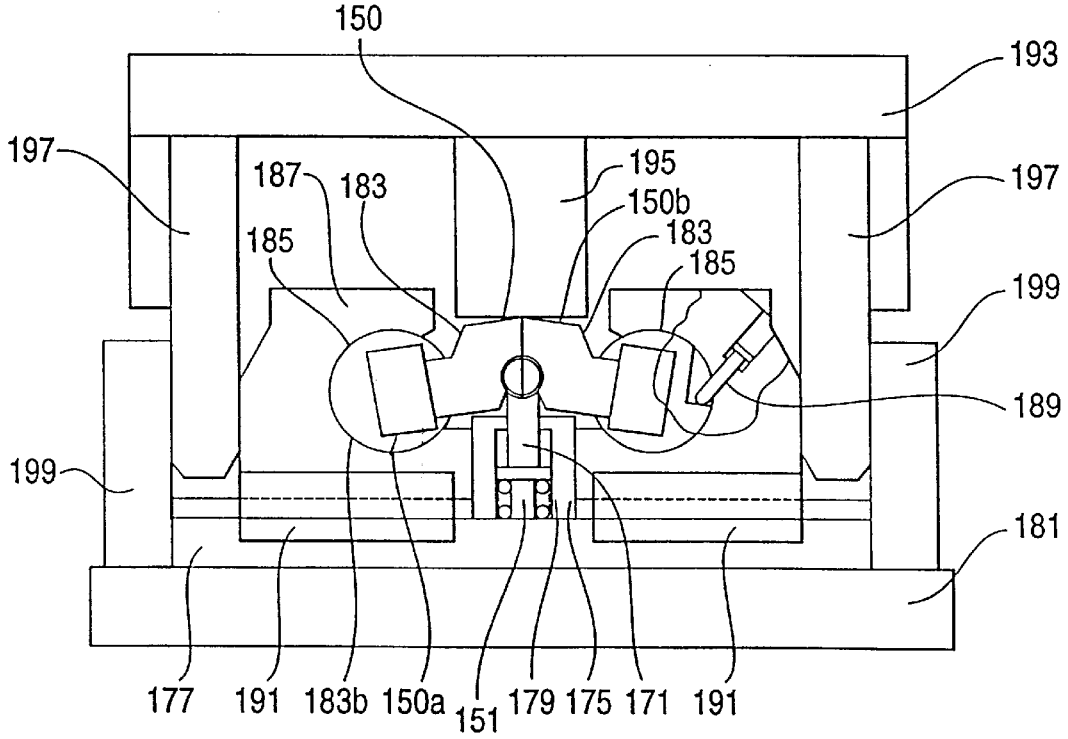
FIG. 10 is a front view of another embodiment of a header pipe cylindrical work apparatus according to the invention, showing a state thereof after it has finished its working operation.

Now, FIG. 10 shows another embodiment of a header pipe cylindrical work apparatus according to the invention and, in this embodiment, there is further provided a lifter pressing lever 150 which can be rotated together with the punches 183 to press against the lifter 171. In this embodiment, two levers 150 are provided two sides in the longitudinal direction of the lifter 171.

The lifter pressing lever 150 includes a rectangular-shaped mounting portion 150*a* in the rear end portion thereof, while the mounting portion 150*a* is fixed to the end face of the support portion 183*b* of one of the punches 183.

And, the lifter pressing lever 150 also includes a cylindrically-shaped pressing portion 150*b* in the front end portion thereof.

The pressing portion 150*b* has an outside diameter which is substantially equal to the outside diameter of the pair of semidivided cylindrical portions 135 when they are butted against each other, while the center of the pressing portion 150*b* is situated at the same position as the center of the butting recessed portion 183*a* formed in the punch 183.

Also, in the present embodiment, there is provided stopper means which is used to stop the movement of the lifter 171 at the lower dead point of the upper holder 193.

This stopper means is composed of a positioning block 151 which is situated inside the hold member 175 and downwardly of the lifter 171 and is fixed to the base member 177.

In the header pipe cylindrical work apparatus according to the present embodiment, since there is disposed the lifter pressing lever 150 which can be rotated together with the punches 183 to press against the lifter 171, a pressing force to be applied to the connecting portion 137 can be restricted, which makes it possible to increase the energizing forces of the coil springs 179 serving as the energizing means.

That is, in the header pipe cylindrical work apparatus according to the previously described embodiment, in order to apply the same apparatus to header pipes which are different in the length required, if the longitudinal length (in the direction perpendicular to the paper surface) of the lifter 171 is set as a length capable of working a header pipe having the greatest length required and the energizing forces of the coil springs 179 are so set as to correspond to this length, then the energizing forces of the coil springs 179 are increased, which raises a fear that, when a workpiece 173 having a short length is worked, the workpiece 173 can be deformed inwardly.

On the other hand, in the header pipe cylindrical work apparatus according to the present embodiment, since there is further disposed the lifter pressing lever 150 which can be rotated together with the punches 183 to press against the lifter 171, a pressing force to be applied to the connecting portion 137 can be restricted. Due to this, the energizing forces of the coil springs 179 can be set as the energizing forces that are capable of working the header pipe having the greatest length required.

Also, in the header pipe cylindrical work apparatus according to the aforementioned embodiment, because the movement of the lifter 171 can be stopped at the lower dead point of the upper holder 193 by the positioning block 151, the rotation of the punches 183 can be surely stopped at the lower dead point. This makes it possible to surely prevent the butted portions of the pair of semidivided cylindrical portions 135 from being deformed due to the further rotation of the punches 183 exceeding the lower dead point.

Next, description will be given below of the other embodiments of a header pipe and a method for manufacturing the same according to the invention.

Figure 11:
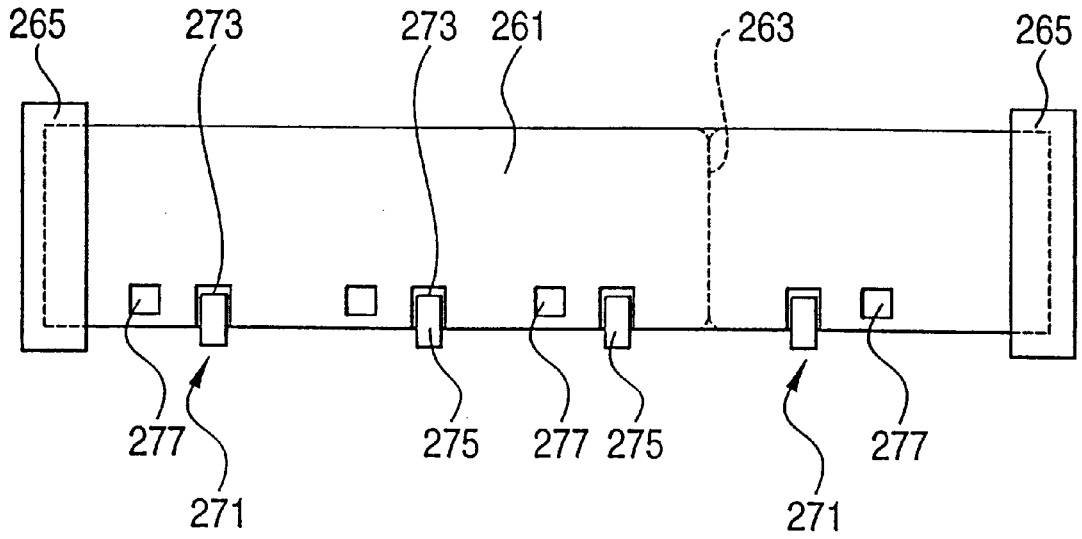
FIG. 11 is a side view of an embodiment of a header pipe according to the invention.
Figure 12:
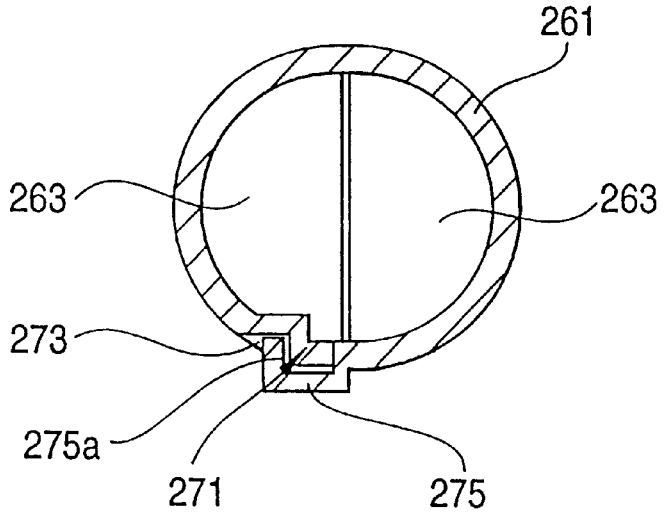
FIG. 12 is a sectional view of the fitting portion of the header pipe shown in FIG. 11.
Figure 13:
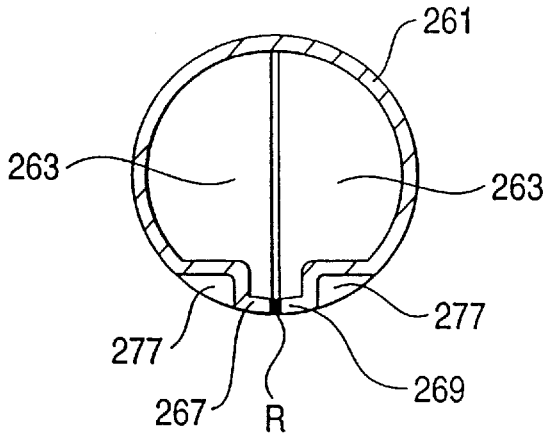
FIG. 13 is a sectional view of pressing recessed portions formed in the header pipe shown in FIG. 11.

In particular, FIGS. 11 to 13 respectively show a header pipe according to a still another embodiment of the invention. This header pipe is used as a tank for a heat exchanger such as a capacitor or the like, and it includes a header pipe main body 261 formed of aluminum, while, on one side of the header pipe main body 261, there are formed a pair of semidivided partition portions 263 which are respectively used to partition the passage of a refrigerant.

The header pipe main body 261 has a cylindrical shape, while two patch ends 265 each formed of aluminum are respectively fitted with and brazed to the two side portions of the cylindrical-shaped header pipe main body 261.

One side edge portion 267 and the other side edge portion 269 of the header pipe main body 261, as shown in FIG. 13, are brazed to each other.

And, as shown in FIG. 11, in the longitudinal direction of the header pipe main body 261, there are formed a plurality of securing portions 271 which are spaced at intervals from each other.

Each of the securing portions 271, as shown in FIG. 12, includes a securing recessed portion formed integrally with one side edge portion 267 of the header pipe main body 261, and a caulking pawl portion 275 formed integrally with the other side edge portion 269 of the header pipe main body 261.

And, the leading end portion 275*a* of the caulking pawl portion 275 is stored in a securing recessed portion 273 which is formed in the header pipe main body 261.

Also, as shown in FIGS. 11 and 13, in the neighborhood of one side edge portion 267 and the other side edge portion 269 of the header pipe main body 261, there are formed pressing recessed portions 277 which, when one side edge portion 267 and the other side edge portion 269 are connected to each other, are used to press against one side edge portion 267 and the other side edge portion 269 in their mutually opposing directions.

The pressing recessed portions 277 are formed at intervals from each other in the longitudinal direction of the header pipe main body 261.

And, according to the present embodiment, the pressing recessed portions 277 are formed in the neighborhood of both sides of the pair of semidivided partition portions 263.

The above-mentioned header pipe is manufactured in the following manner.

Figure 14:
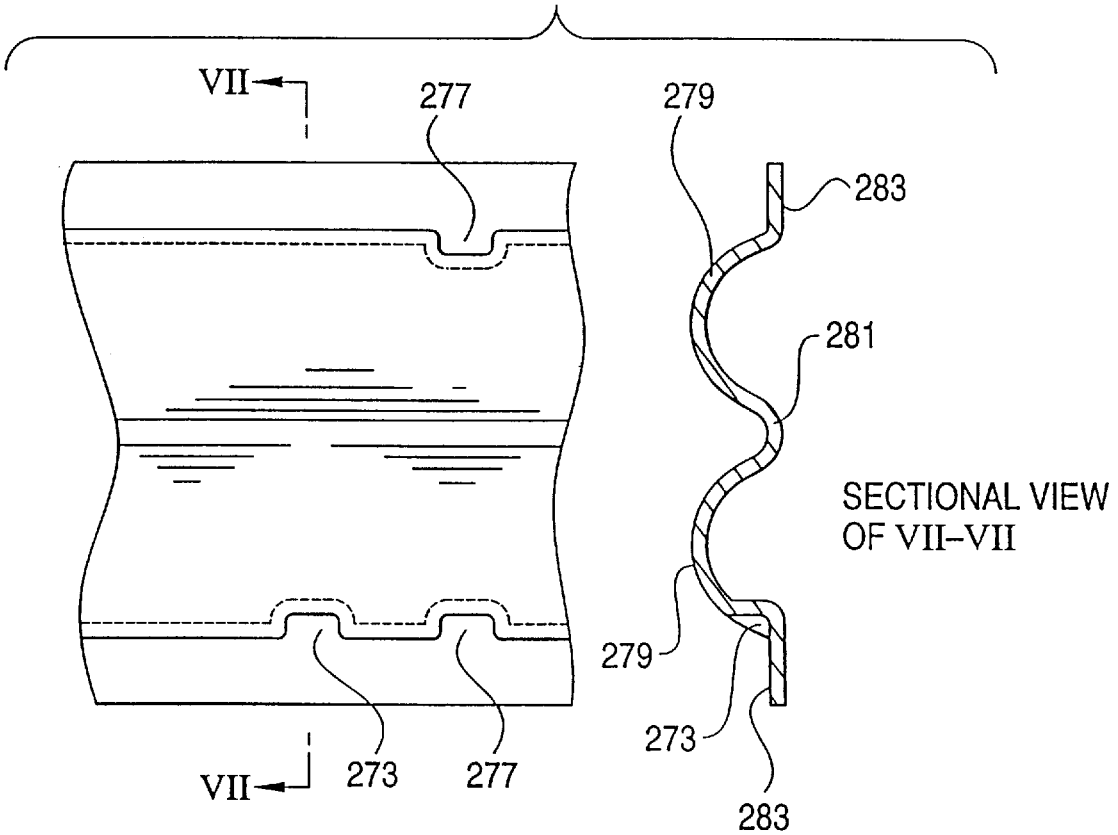
FIG. 14 is an explanatory view of a molding step employed in an embodiment of a pipe manufacturing method according to the invention.

At first, according to a molding step shown in FIG. 14, a flat plate formed of aluminum is molded to thereby form a pair of semicircular-shaped semidivided cylindrical portions 279.

The pair of semidivided cylindrical portions 279 are arranged in parallel to each other with an arc-shaped connecting portion 281.

And, at the same time when the pair of semidivided cylindrical portions 279 are formed, in the respective edge portions of the pair of semidivided cylindrical portions 279, there are formed flat portions 283 which respectively project outwardly.

Further, at the same time when the pair of semidivided cylindrical portions 279 are formed, on the edge portions of the pair of semidivided cylindrical portions 279, there are formed the pressing recessed portions 277; whereas, on the edge portion side of one of the semidivided cylindrical portions 279, there is formed the securing recessed portion 273.

The above-mentioned molding step can be achieved by holding the flat plate between given metal molds and then molding the same by pressing.

Figure 15:
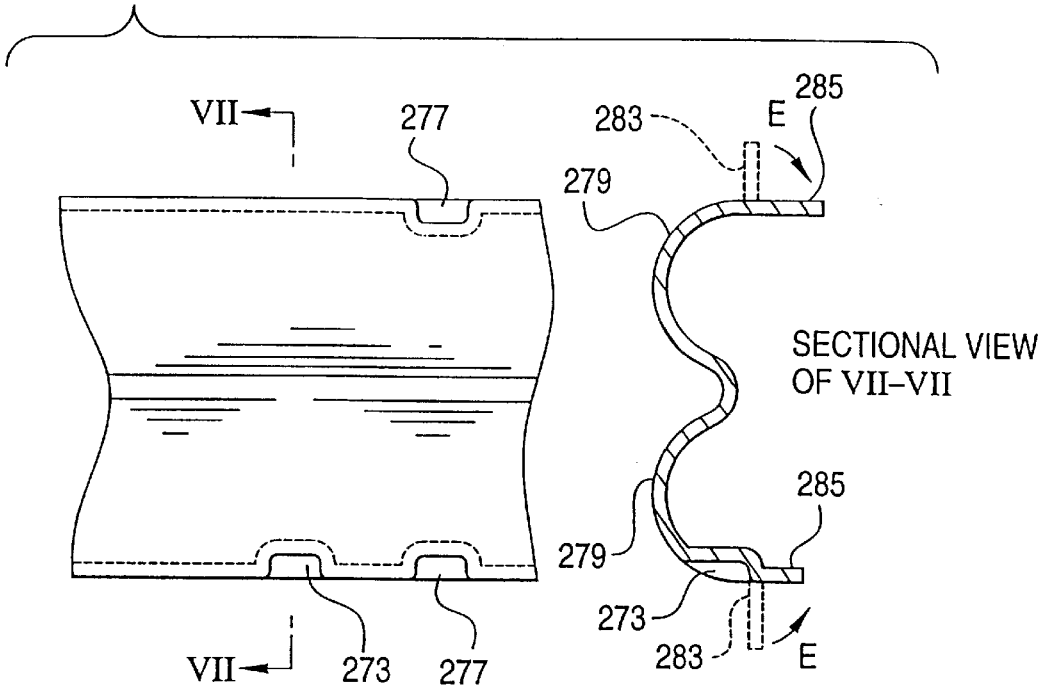
FIG. 15 is an explanatory view of a bending step employed in the above embodiment of the method for manufacturing the header pipe according to the invention.

Next, according to a bending step shown in FIG. 15, the flat portions 283 are respectively bent in the opening direction (arrow E) of their respective semidivided cylindrical portions 279 to thereby form flange portions 285.

Figure 16:
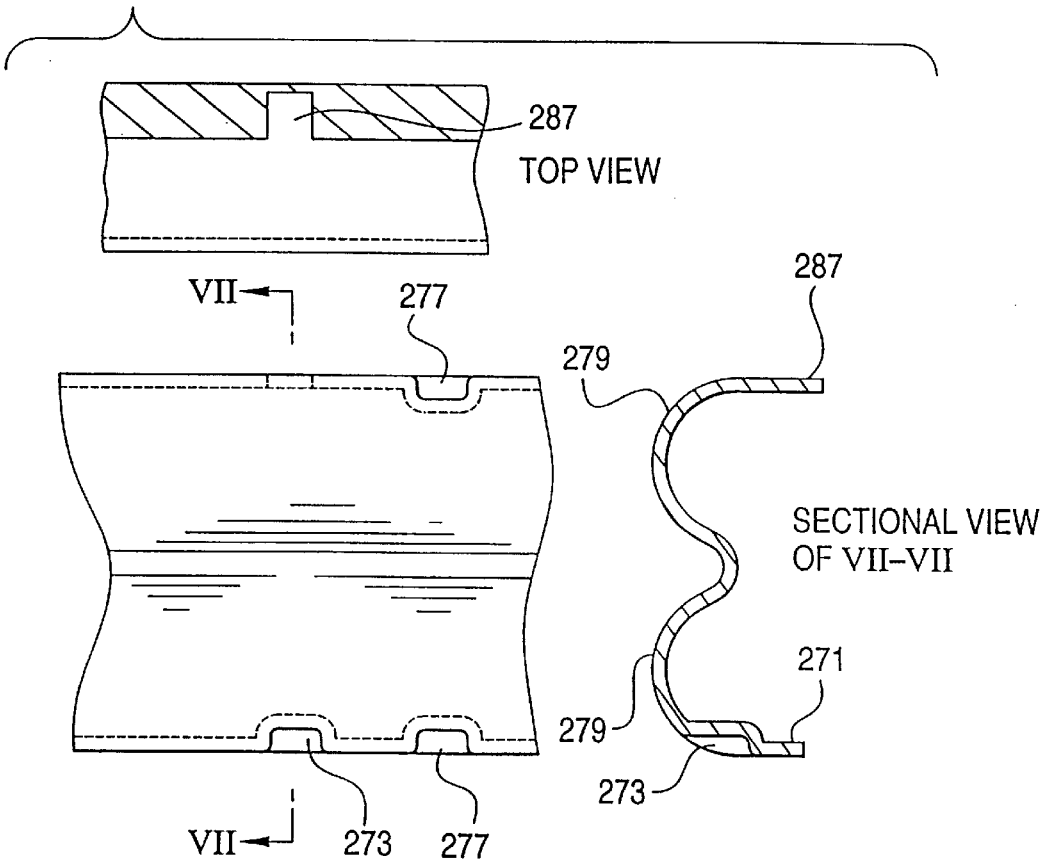
FIG. 16 is an explanatory view of a cutting step employed in the above embodiment of the method for manufacturing the header pipeaccording to the invention.

After then, according to a cutting step shown in FIG. 16, the flange portions 285 are cut and removed except for the portions thereof corresponding to the securing recessed portions 273, that is, the portions of the flange portions 285 that are shown by oblique lines in FIG. 16 are cut and removed, so that a securing portion 271 is formed on the securing recessed portion 273 side.

Also, on the opposite side of the securing recessed portion 273, there is formed a caulking pawl portion forming portion 287.

This cutting step can be accomplished by trimming the flat plate using a piece of press work apparatus.

Figure 17:
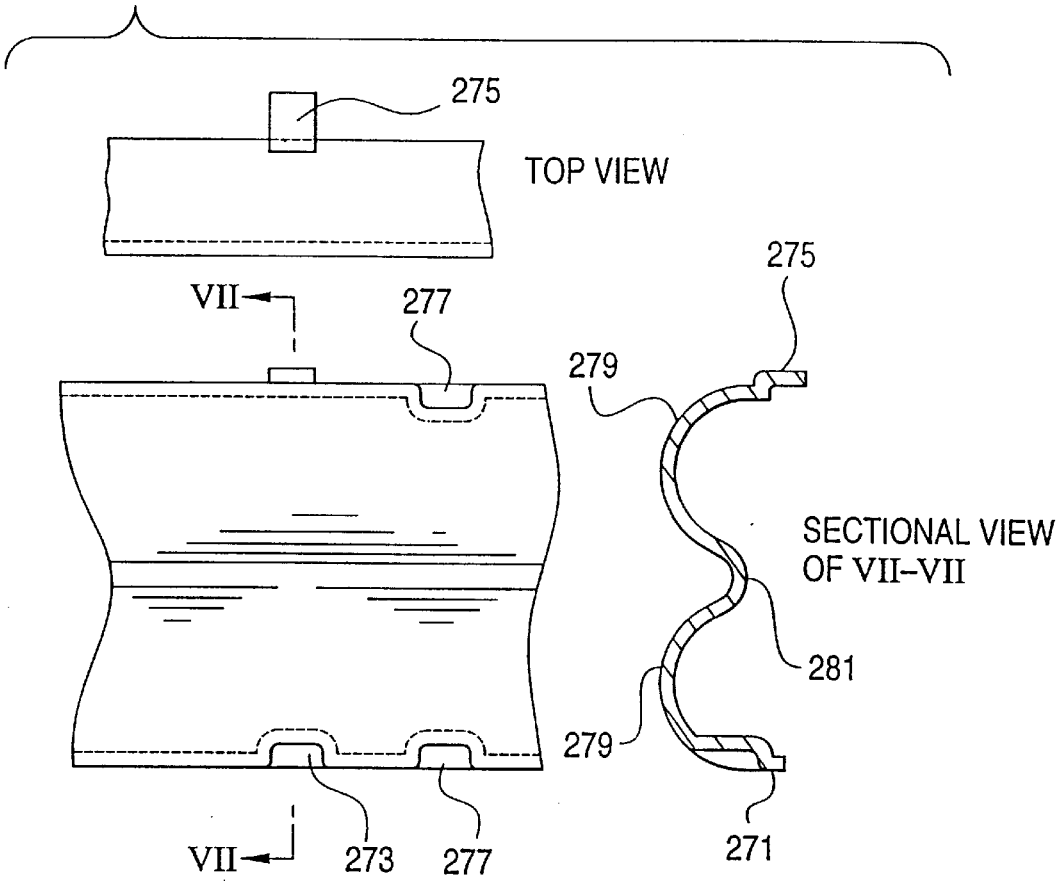
FIG. 17 is an explanatory view of a caulking pawl portion molding step employed in the above embodiment of the method for manufacturing the header pipe according to the invention.

Next, according to a caulking pawl portion forming step shown in FIG. 17, the caulking pawl portion forming portion 287 is pushed out outwardly by an amount corresponding to the thickness of the flat plate to thereby form the caulking pawl portion 275.

Figure 18:
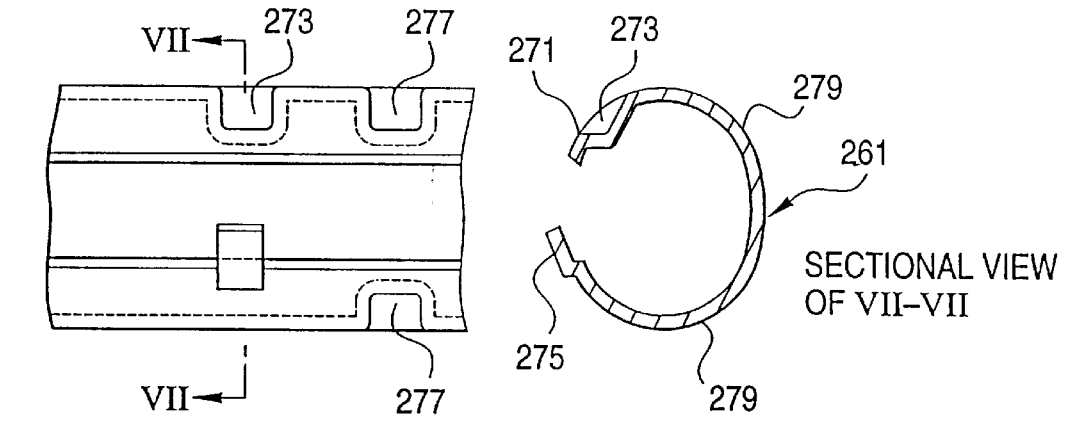
FIG. 18 is an explanatory view of a mutually opposing step employed in the above embodiment of the method for manufacturing a header pipe according to the invention.

After then, according to a mutually opposing step shown in FIG. 18, the connecting portion 281 is projected from the inside thereof to thereby dispose the semidivided cylindrical portions 279 in such a manner that they are substantially opposed to each other.

The mutually opposing step can be achieved in the following manner: that is, the semidivided cylindrical portions 279 are stored in a metal mold (not shown) and then the connecting portion 281 is pressed against the arc-shaped portion of the metal mold using a punch.

Finally, according to a curling step, the pair of substantially mutually opposed semidivided cylindrical portions 279 are butted against each other and, at the same time, the caulking pawl portion 275 is bent along the outside portion of the securing portion 271 so that the caulking pawl portion 275 is fitted with the securing portion 271.

Figure 19:
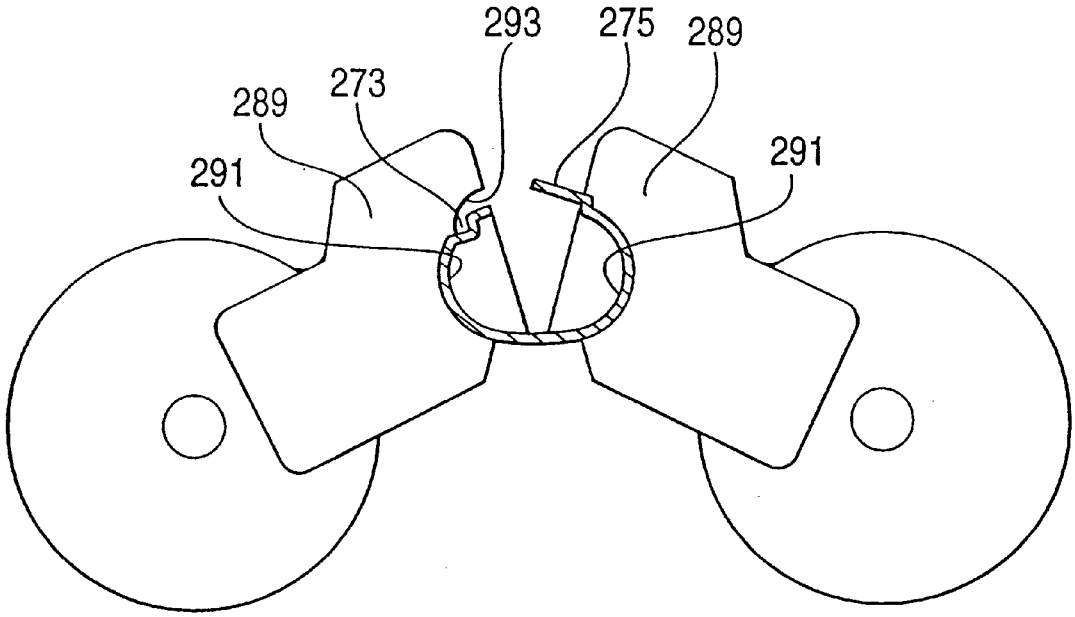
FIG. 19 is an explanatory view of a curling step employed in the above embodiment of the method for manufacturing the header pipe according to the invention.

This curling step can be carried out in the following manner: that is, the header pipe main body 261 formed in such a manner as shown in FIG. 18, as shown in FIG. 19, is stored in a pair of mutually opposed metal molds 289 and then the metal molds 289 are moved. Incidentally, the pair of metal molds 289 can be assembled into the apparatuses shown in FIGS. 8 to 10 as the pair of punches 183.

In both of the metal molds 289, there are respectively formed semicircular-shaped arc portions 291, whereas, in the edge portion of one of the metal molds 289, there is formed a curling portion 293.

Figure 20:
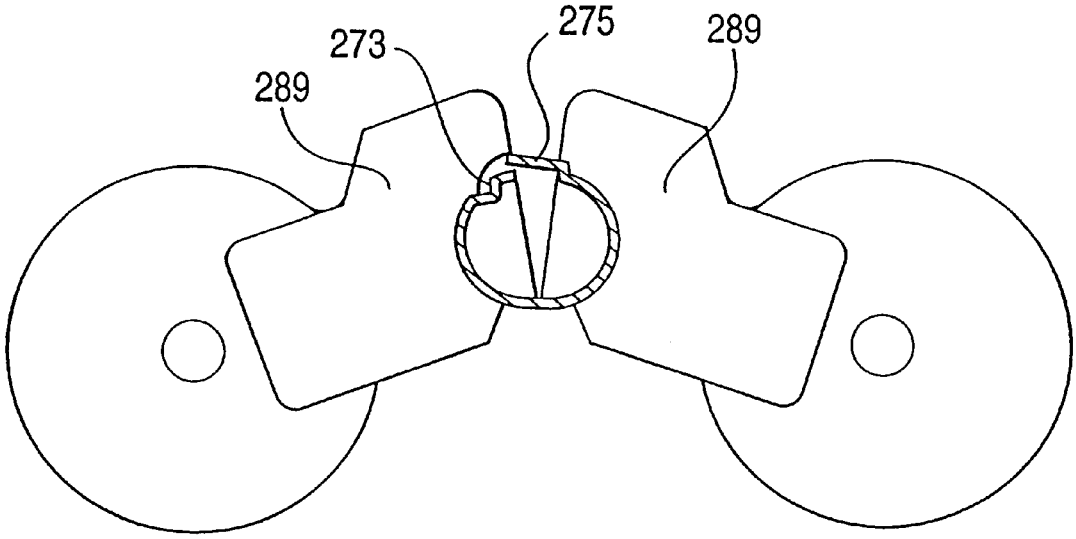
FIG. 20 is an explanatory view of the curling step employed in the above embodiment of the method for manufacturing the header pipe according to the invention.
Figure 21:
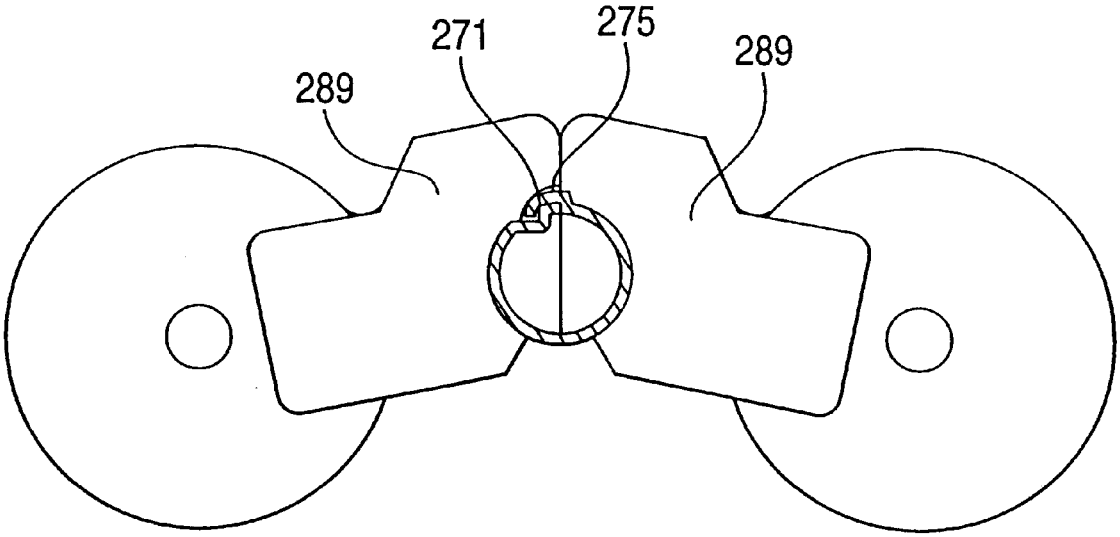
FIG. 21 is an explanatory view of the curling step employed in the above embodiment of the method for manufacturing the header pipe according to the invention.

And, both of the metal molds 289, as shown in FIGS. 20 and 21, are rotated sequentially so that the caulking pawl portion 275 is curled toward the securing recessed portion 273.

That is, as shown in FIG. 20, after the leading end of the caulking pawl portion 275 is contacted with the wall portion of the curling portion 293, if the metal molds 289 are closed further, then the caulking pawl portion 275 is curled along the securing portion 271, as shown in FIG. 21.

Figure 22:
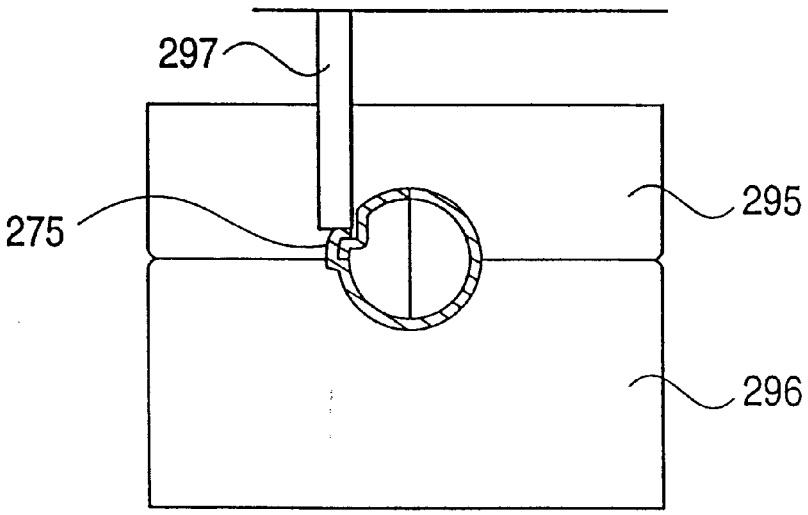
FIG. 22 is an explanatory view of a caulking step employed in the above embodiment of the method for manufacturing a header pipe according to the invention.

After then, as shown in FIG. 22, while the header pipe main body 261 is being held between two metal molds 295 and 296, the caulking pawl portion 275 is caulked and fixed to the securing portion 271 by a punch 297.

Figure 23:
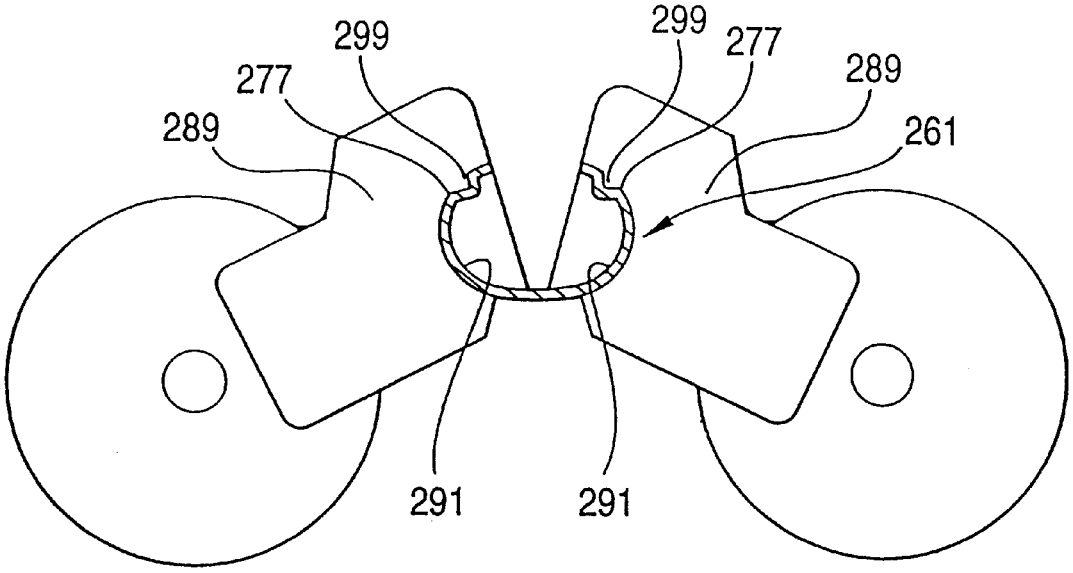
FIG. 23 is an explanatory view of pressing recessed portions in the state of FIG. 19.

On the other hand, in the state shown in FIG. 19, as shown in FIG. 23, pressing portions 299, which are respectively formed in the metal molds 289 in such a manner that they project inwardly from the arc-shaped portions 291 of the metal molds 289, are secured to the pressing recessed portions 277 respectively formed in the neighborhood of one side edge portion 267 and the other side edge portion 269 of the header pipe main body 261.

From this state, as shown in FIGS. 20 and 21, if the metal molds 289 are rotated and moved, then one side edge portion 267 and the other side edge portion 269 are positively pressed in their mutually opposing directions while the pressing recessed portions 277 are always pressed by the pressing portions 299 of the metal molds 289.

After then, a brazing step is executed: that is, not only one side edge portion 267 and the other side edge portion 269 are brazed to each other but also the securing portion 271 and caulking pawl portion 275 are brazed to each other.

This brazing operation is carried out in the following manner: that is, for example, non-corrosive flux is applied onto the brazing portions and, after then, the brazing portions are thermally treated, for example, in the nitrogen ambient condition.

In the header pipe structured in the above-mentioned manner, since, in the neighborhood of one side edge portion 267 and the other side edge portion 269 of the header pipe main body 261, there are formed the pressing recessed portions 277 which, when one side edge portion 267 and the other side edge portion 269 are connected to each other, are used to press against one side edge portion 267 and the other side edge portion 269 in their mutually opposing directions, the neighboring portions of one side edge portion 267 and the other side edge portion 269 of the header pipe main body 261 can be pressed more positively by the pressing portions 299 of the metal molds 289; and, at the same time, even when the caulking pawl portion 275 is formed, one side edge portion 267 and the other side edge portion 269 can be positively connected to each other.

Also, in the above-mentioned header pipe, since the pressing recessed portions 277 are respectively formed in the neighborhood of the pair of mutually opposing semidivided partition portions 263 formed integrally with the inside of the header pipe main body 261, the neighboring portions of the semidivided partition portions 263, which are higher in rigidity than the remaining portions, can be positively connected together.

Further, in the above-mentioned header pipe, because not only one side edge portion 267 and the other side edge portion 269 are brazed to each other but also the securing portion 271 and caulking pawl portion 275 are brazed to each other, there can be obtained a header pipe which is high in both airtightness and liquidtightness.

And, in the above-mentioned header pipe manufacturing method, due to the fact that, while the pressing portions 299 respectively formed in the metal molds 289 are being secured to the pressing recessed portions 277 respectively formed in the neighborhood of one side edge portion 267 and the other side edge portion 269 of the header pipe main body 261, the metal molds 289 are moved to press against one side edge portion 267 and the other side edge portion 269 in their mutually opposing directions to thereby connect them together, the neighboring portions of one side edge portion 267 and the other side edge portion 269 of the header pipe main body 261 can be pressed more positively by the pressing portions 299 of the metal molds 289 and, at the same time, even when the caulking pawl portion 275 is formed, one side edge portion 267 and the other side edge portion 269 can be positively connected to each other.

By the way, in the above-mentioned embodiment, description has been given of an example in which the pressing recessed portions 277 to be secured to the pressing portions 299 of the metal molds 289 are respectively formed in the neighborhood of one side edge portion 267 and the other side edge portion 269 of the header pipe main body 261. However, the invention is not limited to this embodiment but, for example, it is also possible to form, instead of the pressing recessed portions 277, pressing projecting portions which can be secured to the pressing portions formed in the metal molds.

In the above embodiment, one example applied to the header pipe for a heat exchanger is explained. However, this embodiment can be applied to manufacturing method of the any other kinds of the pipes, not limited to the header pipe.

Now, description will be given below of an embodiment of a method for manufacturing a header pipe with a partition using the aforementioned embodiments with reference to the accompanying drawings.

In particular, according to the present embodiment, a header pipe with a partition is manufactured from an aluminum flat plate.

Figure 24:
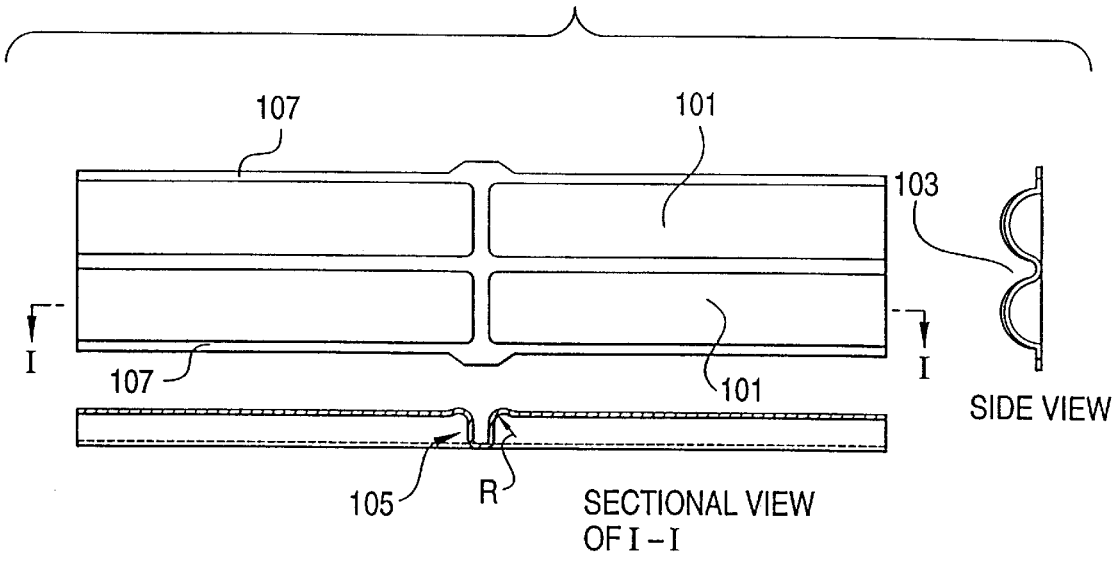
FIG. 24 is an explanatory view of a molding step employed in an embodiment of a method for manufacturing a header pipe according to the invention.

At first, according to a molding step shown in FIG. 24, an aluminum plate member with brazing material layers set on both sides thereof is molded so that there are formed a pair of semidivided cylindrical portions 101.

The pair of semidivided cylindrical portions 101 formed in this manner are arranged in parallel to each other with an arc-shaped connecting portion 103 between them.

And, in the pair of semidivided cylindrical portions 101, there are formed U-shaped partition forming portions 105 which project inwardly of their respective semidivided cylindrical portions 101.

On the respective outside portions of the semidivided cylindrical portions 101, there are formed edge portions 107.

Figure 25:
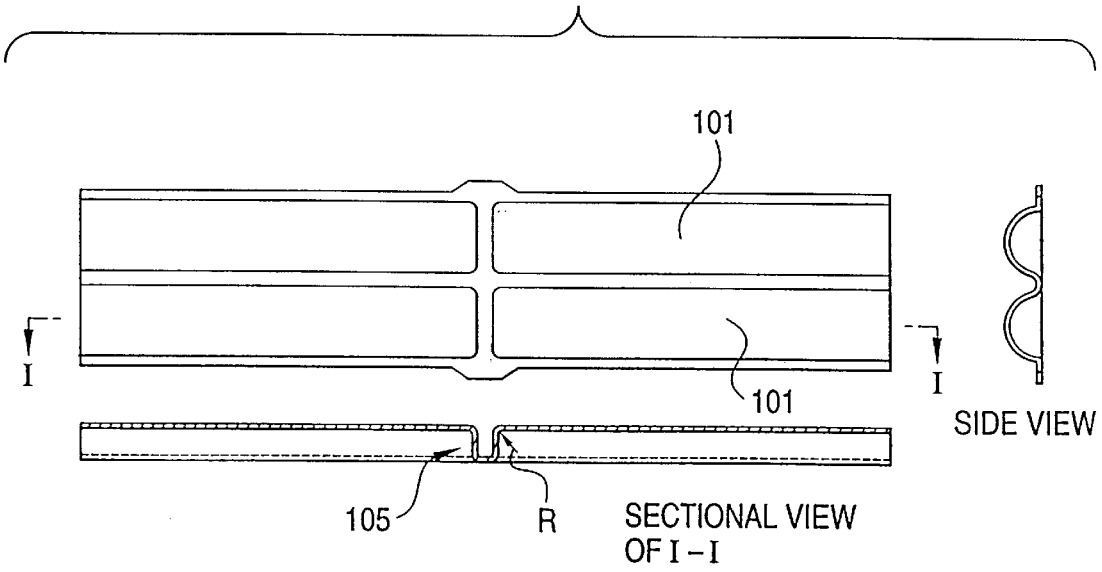
FIG. 25 is an explanatory view of a second molding step employed in the third embodiment of a method for manufacturing a header pipe according to the invention.

Next, according to a second molding step shown in FIG. 25, the base portions of the partition forming portions 105 are respectively molded into an arc shape having a given radius.

Figure 26:
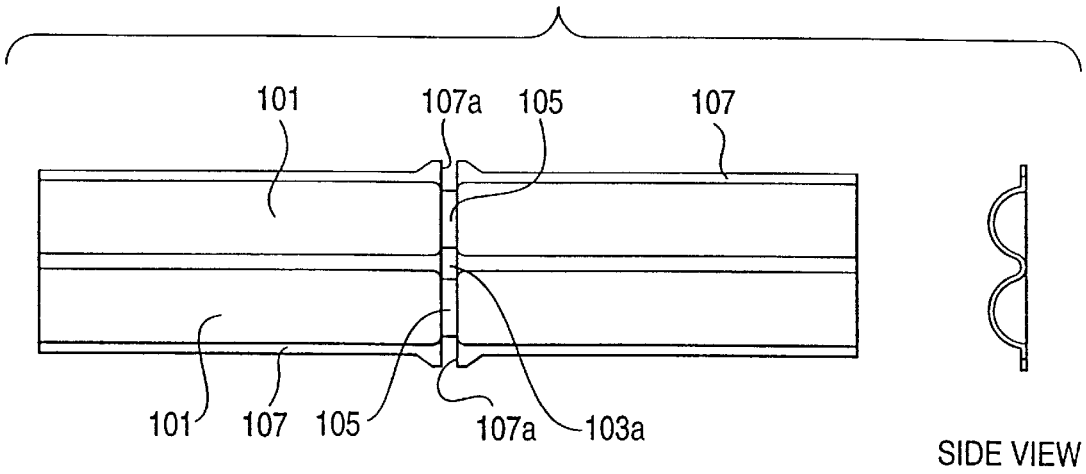
FIG. 26 is an explanatory view of a cutting step employed in the embodiment of a method for manufacturing a header pipe according to the invention.

Next, according to a cutting step shown in FIG. 26, not only a connecting portion 103*a* situated between the mutually adjoining partition forming portions 105 but also edge portions 107*a* respectively situated on both sides of the partition forming portions 105 are cut and removed together with the excessively increased thickness portions of the edge portions 107.

This cutting step can be achieved by trimming and piercing the aluminum flat plate using a piece of press work machinery.

Figure 27:
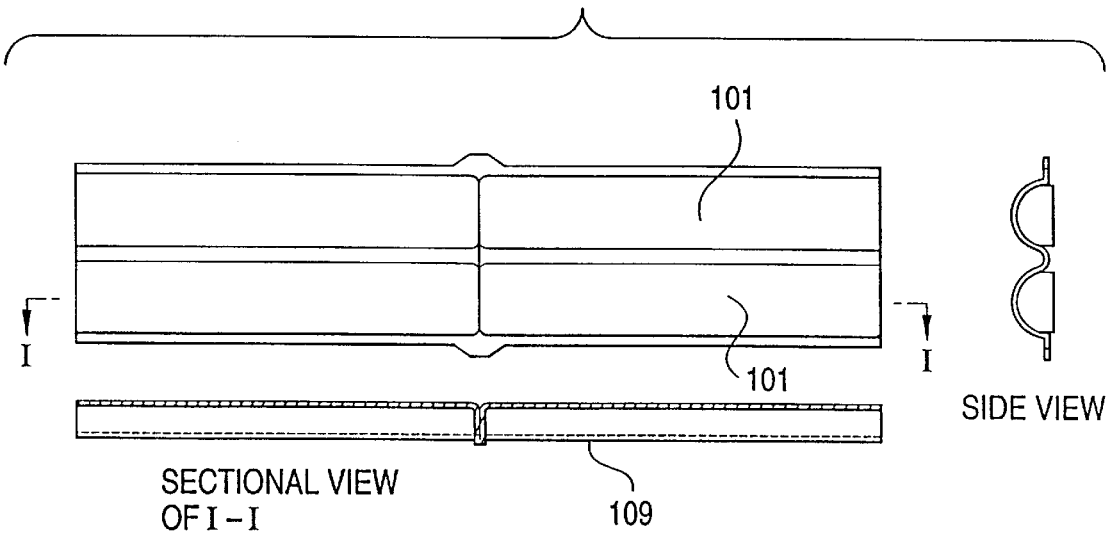
FIG. 27 is an explanatory view of a compressing step employed in the embodiment of a method for manufacturing a header pipe according to the invention.

After completion of the cutting step, according to a compressing step shown in FIG. 27, the partition forming portions 105 are compressed from both sides thereof so that there is formed a semidivided partition portion 109.

Figure 28:
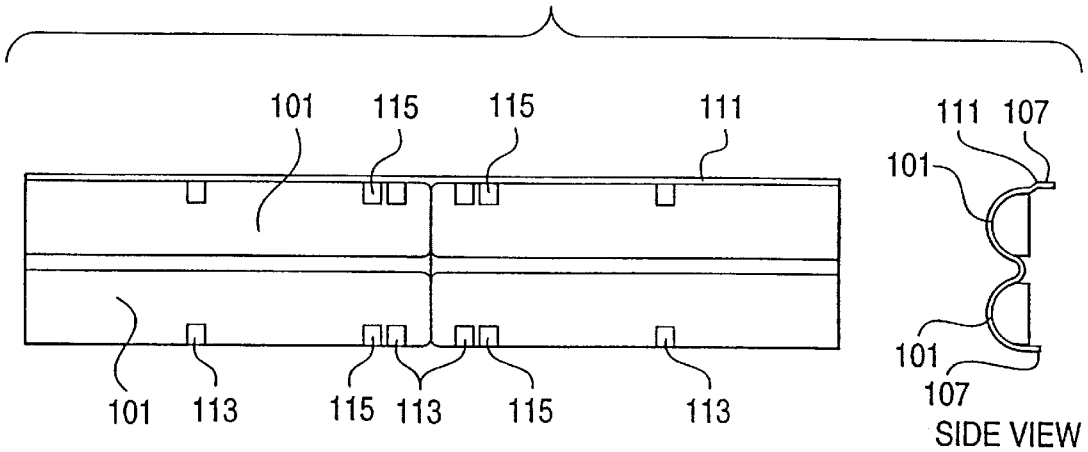
FIG. 28 is an explanatory view of an edge portion molding step employed in the embodiment of a method for manufacturing a header pipe according to the invention.

Next, according to an edge portion molding step shown in FIG. 28, the edge portions 107 of the pair of semidivided cylindrical portions 101, which are respectively situated on both sides of the semidivided cylindrical portions 101, are molded so that, as shown in FIG. 28, each of the edge portions 107 is formed into an arc shape which continues with its associated semidivided cylindrical portion 101.

Also, in the edge portion 107 in which a plurality of caulking pawl portions (which will be discussed later) are to be formed, there is formed a stepped portion 111 and, at the same time, a plurality of securing recessed portions 113 for caulking and fixing the caulking pawl portions as well as a plurality of pressing recessed portions 115 are formed by embossing.

This edge portion molding step can be achieved by holding the pair of semidivided cylindrical portions 101 between given metal molds and then molding them by pressing.

Figure 29:
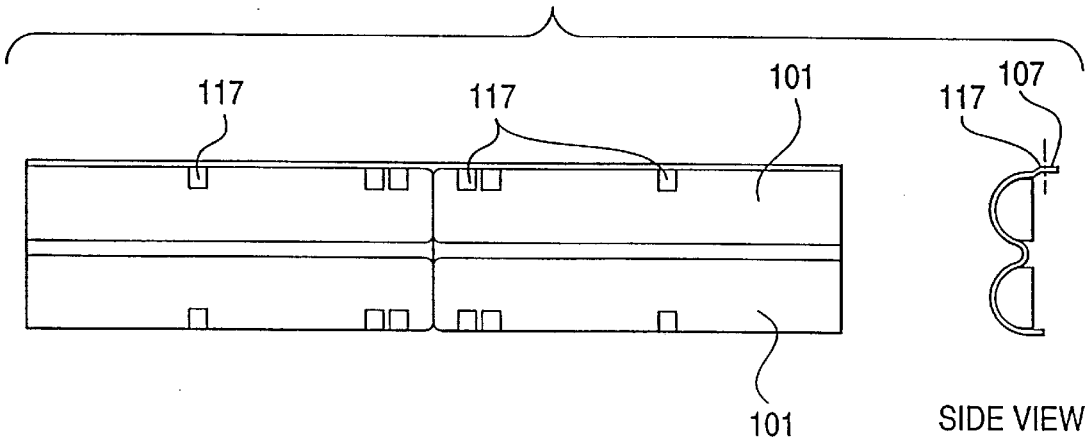
FIG. 29 is an explanatory view of a second cutting step employed in the embodiment of a method for manufacturing a header pipe according to the invention.

After completion of the edge portion molding step, according to a second cutting step shown in FIG. 29, the unnecessary portions of the edge portion 107 except for the portions thereof to be used as the caulking pawl portions 117 are trimmed, so that the caulking pawl portions 117 can be formed.

Figure 30:
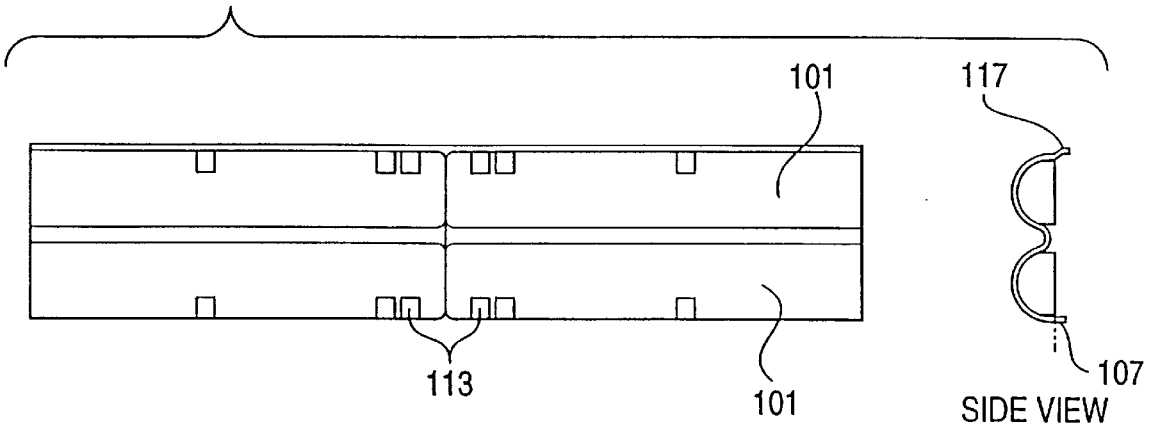
FIG. 30 is an explanatory view of a third cutting step employed in the embodiment of a method for manufacturing a header pipe according to the invention.

Next, according to a third cutting step shown in FIG. 30, the unnecessary portions of the edge portion 107 situated on the securing recess 113 side are cut and removed by trimming.

Figure 31:
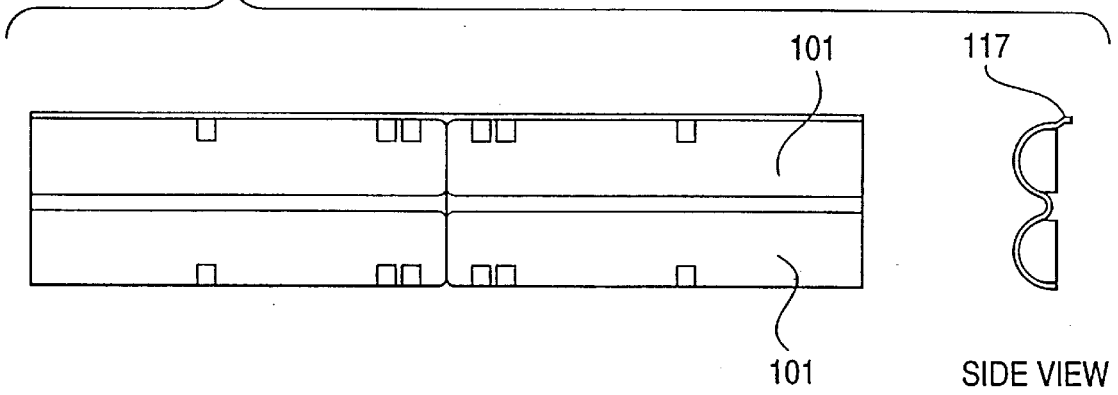
FIG. 31 is an explanatory view of a restriking step employed in the embodiment of a method for manufacturing a header pipe according to the invention.

After the third cutting step is completed, according to a restriking step shown in FIG. 31, the caulking pawl portions 117 are restruck into right angles.

And, in this restriking step, as previously described in the embodiment shown in FIGS. 1, the end faces of the edge portions of the flat plate are face-struck so that they are respectively formed into a linear shape. Of course, if the edge portions 107 are cut into a shape having a larger dimension than that of a finally required shape thereof in the second and third cutting steps, face-strike operation is not necessary.

Figure 32:
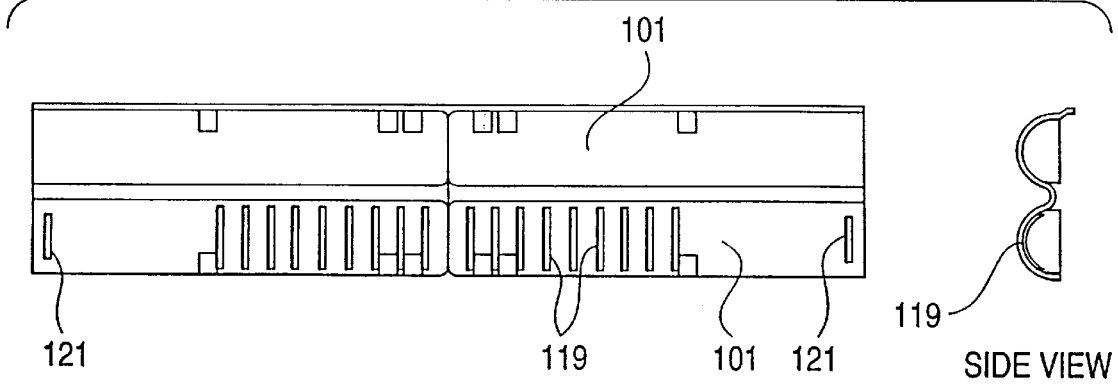
FIG. 32 is an explanatory view of a first tube insertion hole forming step employed in the embodiment of a method for manufacturing a header pipe according to the invention.

After completion of the restriking step, according to a first tube insertion hole forming step shown in FIG. 32, in the central portion of one of the pair of semidivided cylindrical portions 101, there are formed a plurality of tube insertion holes 119 which are spaced at given intervals from each other; and, on both sides of the present semidivided cylindrical portion 101, there are formed insertion holes 121 into which side plates can be inserted.

This first tube insertion hole forming step can be achieved by slit/pierce molding the aluminum flat plate using a piece of press work machinery.

Figure 33:
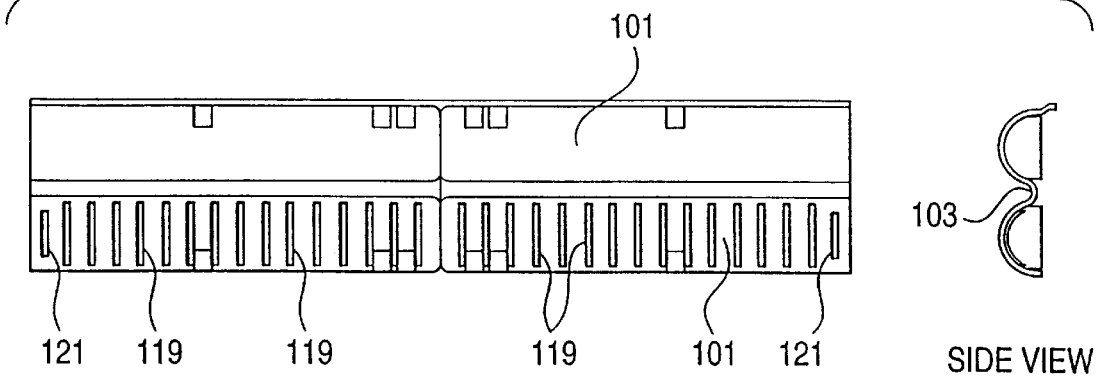
FIG. 33 is an explanatory view of a second tube insertion hole forming step employed in the embodiment of a method for manufacturing a header pipe according to the invention.

Next, according to a second tube insertion hole forming step shown in FIG. 33, on both sides of the tube insertion holes 119 formed in the central portion of the semidivided cylindrical portions 101, there are formed another tube insertion holes 119 which are also spaced at given intervals from each other.

The second tube insertion hole forming step can be achieved by slit/pierce molding the aluminum flat plate using a piece of press work machinery.

Figure 34:
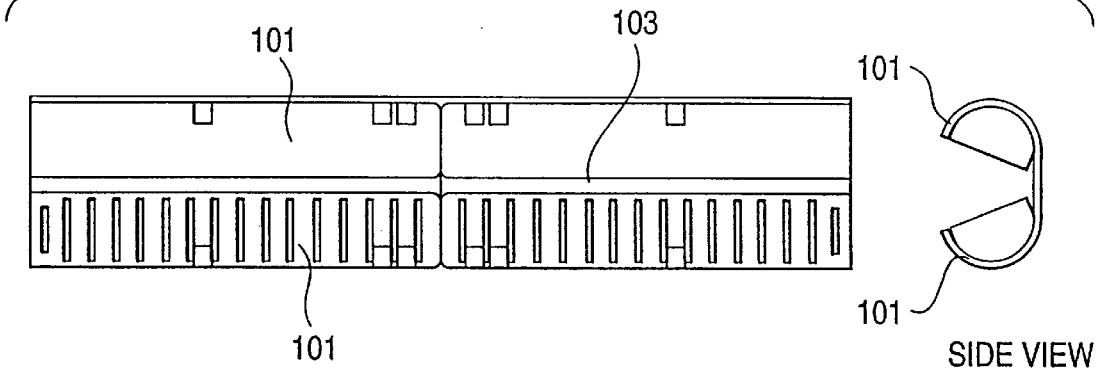
FIG. 34 is an explanatory view of a mutually opposing step employed in the embodiment of a method for manufacturing a header pipe according to the invention.

After then, according to a mutually opposing step shown in FIG. 34, the connecting portion 103 is projected from the inside thereof to thereby dispose the pair of semidivided cylindrical portions 101 in such a manner that they are opposed to each other.

Figure 35:
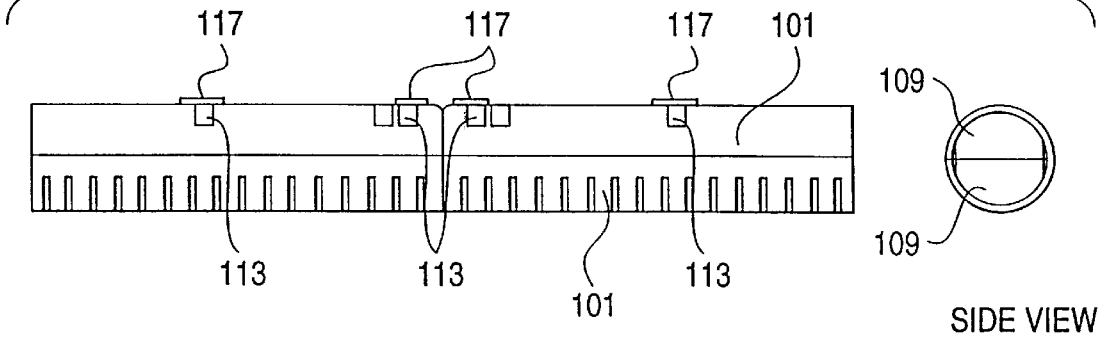
FIG. 35 is an explanatory view of a butting step employed in the embodiment of a method for manufacturing a header pipe according to the invention.
Figure 36:
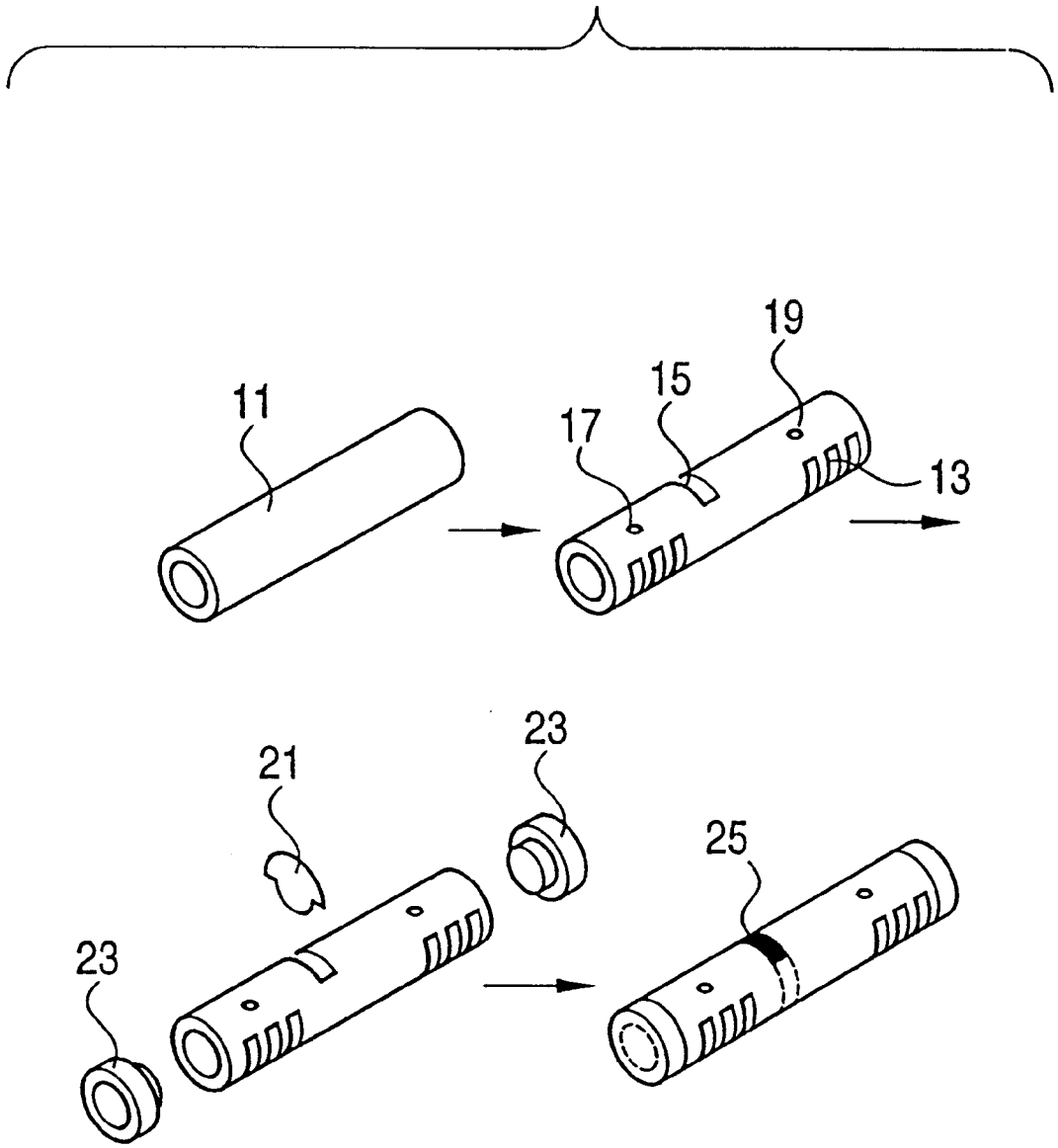
FIG. 36 PRIOR ART
FIG. 36 is an explanatory view of one conventional method for manufacturing a header pipe.
Figure 37:
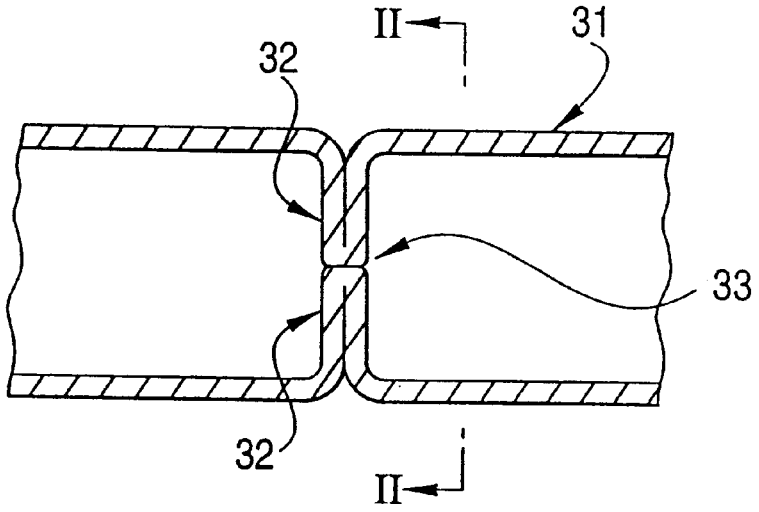
FIG. 37 PRIOR ART
FIG. 37 is a sectional view of a header pipe manufactured by another conventional method for manufacturing a header pipe.
Figure 38:
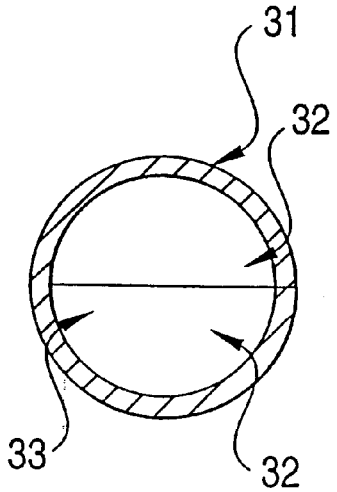
FIG. 38 PRIOR ART
FIG. 38 is a sectional view taken along the line II—II shown in FIG. 37.
Figure 39:
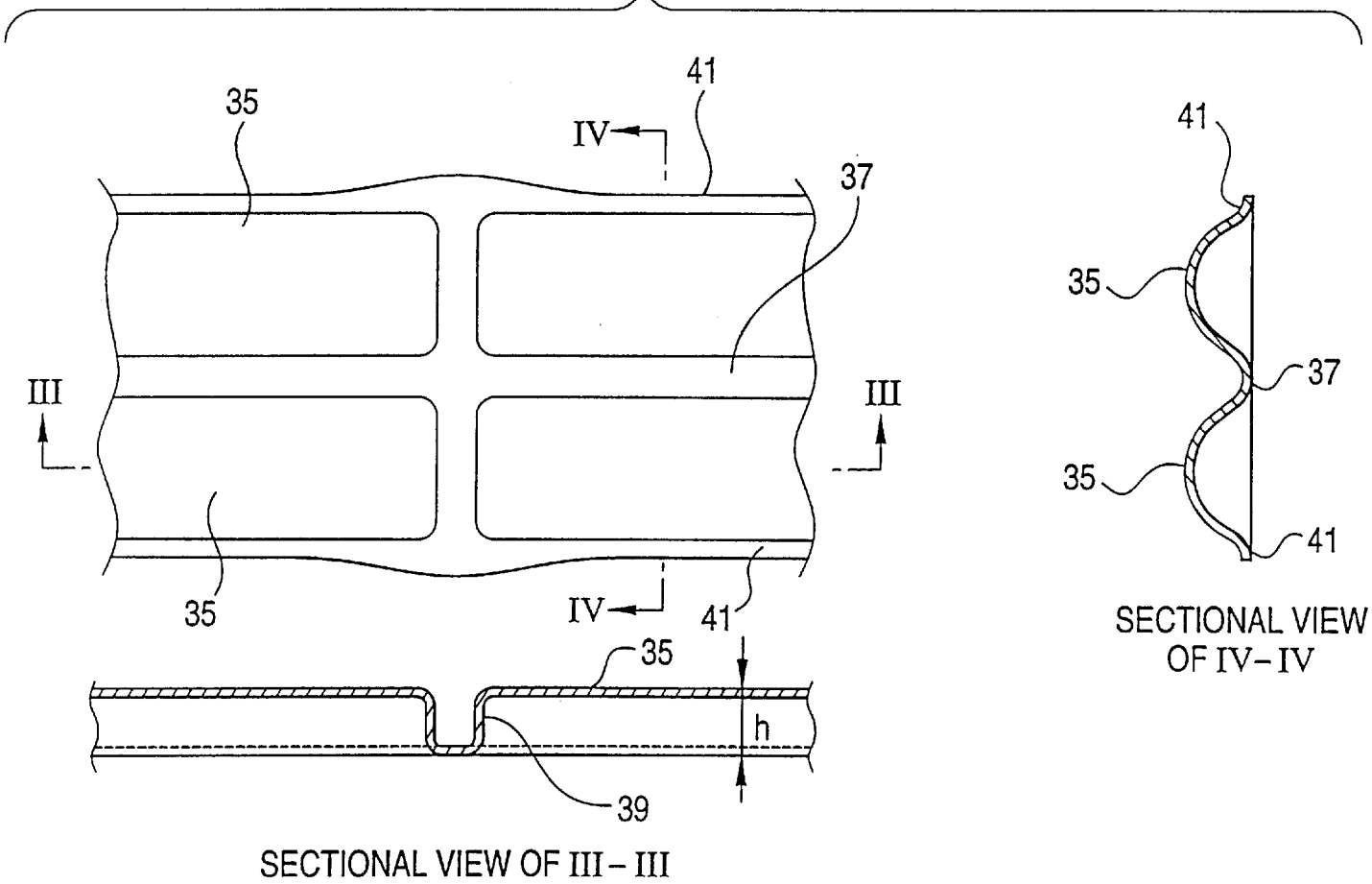
FIG. 39 PRIOR ART
FIG. 39 is an explanatory view of a molding step employed in the conventional method.
Figure 40:
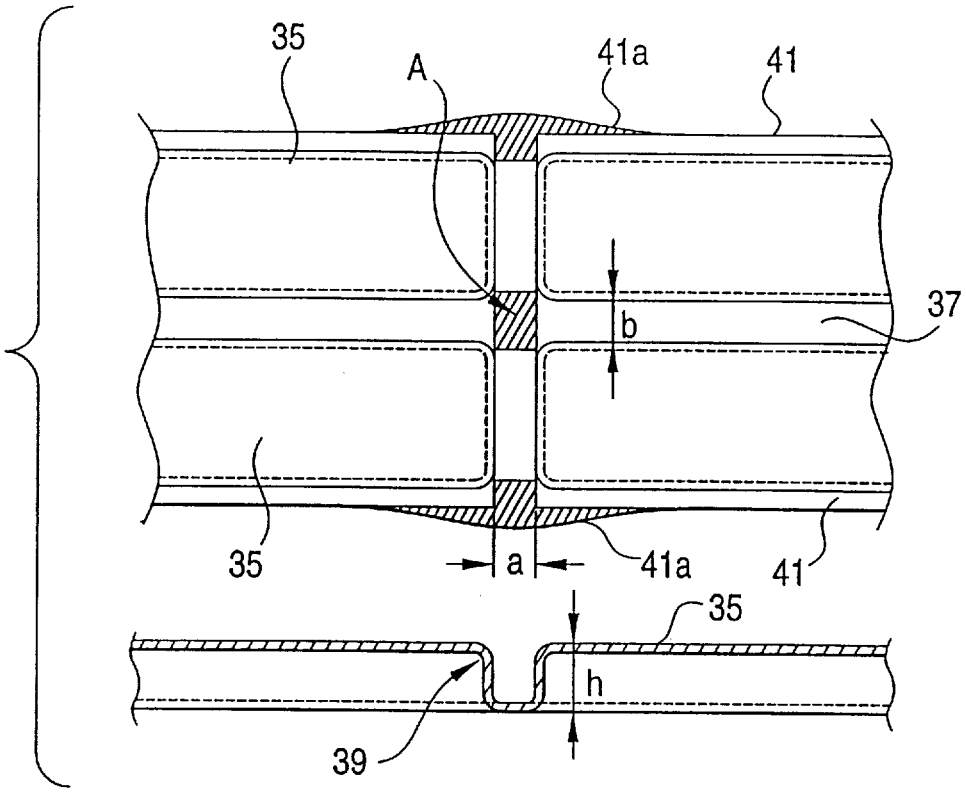
FIG. 40 PRIOR ART
FIG. 40 is an explanatory view of a cutting step employed in the conventional method.
Figure 41:
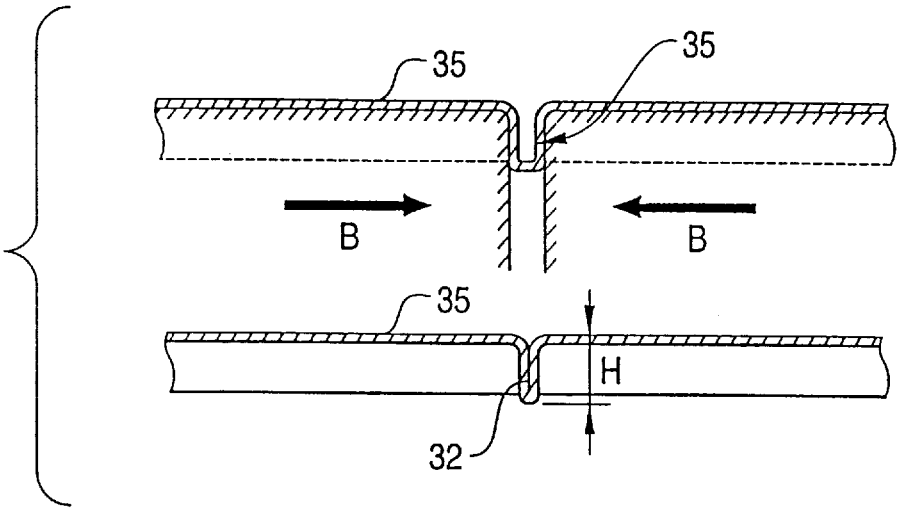
FIG. 41 PRIOR ART
FIG. 41 is an explanatory view of a compressing step employed in the conventional method.
Figure 42:
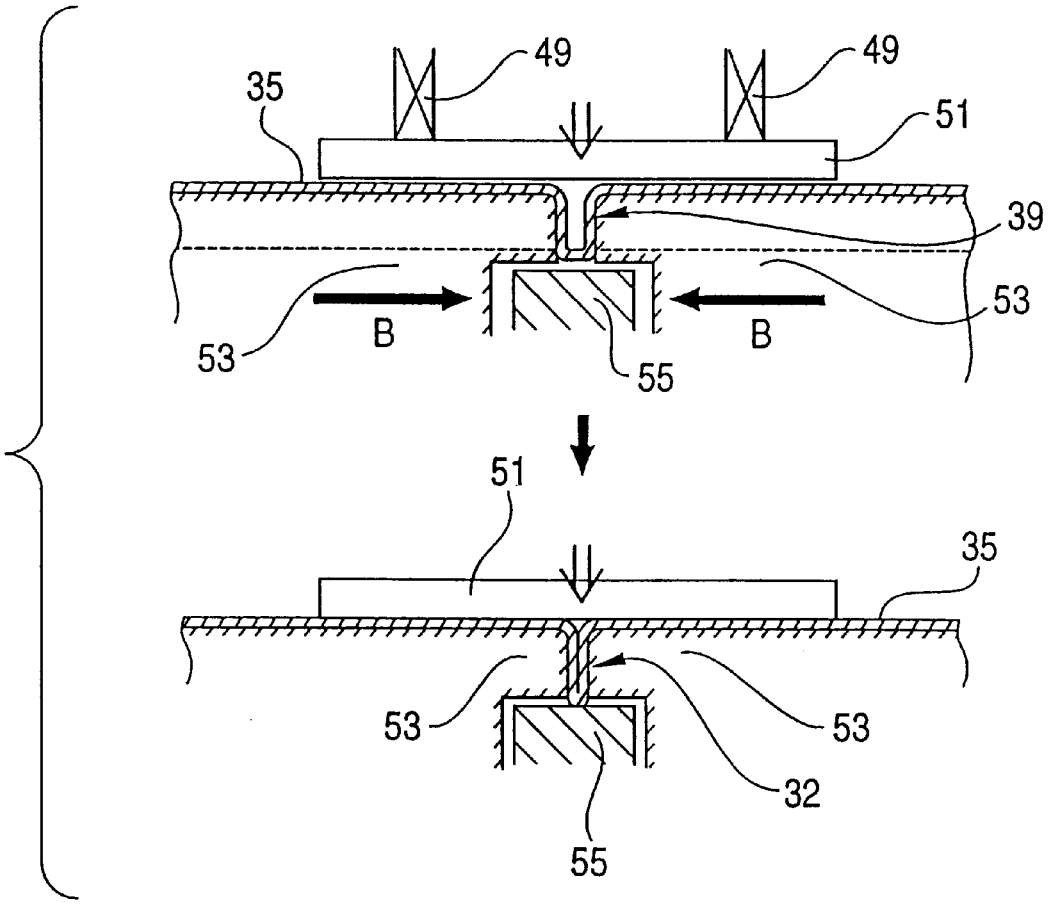
FIG. 42 PRIOR ART
FIG. 42 is an explanatory view of the conventional method, showing a state thereof in which the compressing step employed therein is being executed.
Figure 43:
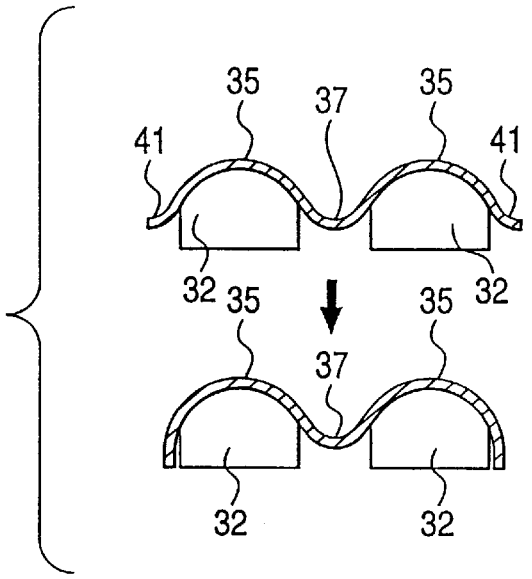
FIG. 43 PRIOR ART
FIG. 43 is an explanatory view of an edge portion molding step employed in the conventional method.
Figure 44:
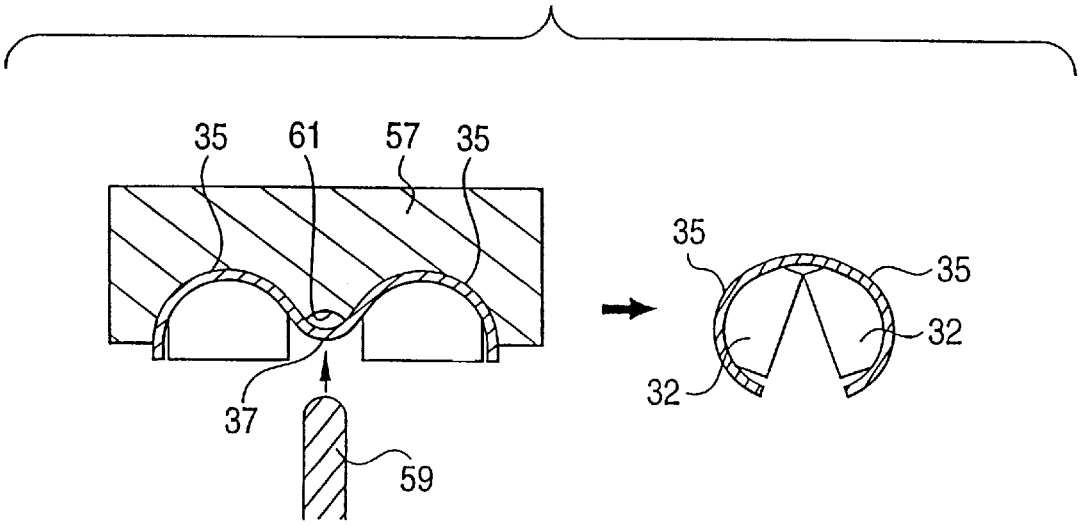
FIG. 44 PRIOR ART
FIG. 44 is an explanatory view of a mutually opposing step employed in the conventional method.
Figure 45:
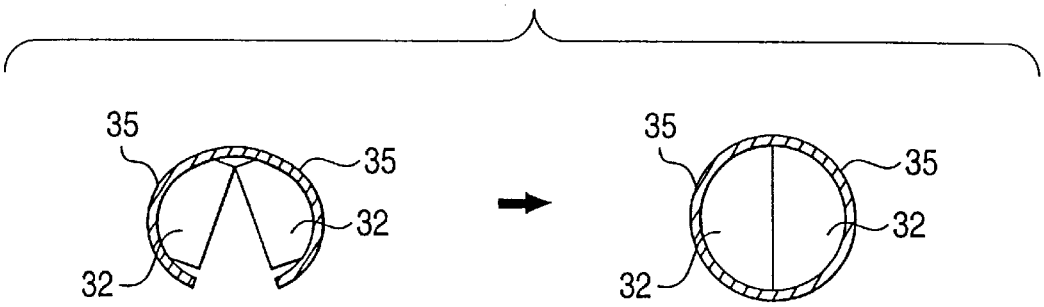
FIG. 45 PRIOR ART
FIG. 45 is an explanatory view of a butting step employed in the conventional method.
Figure 46:
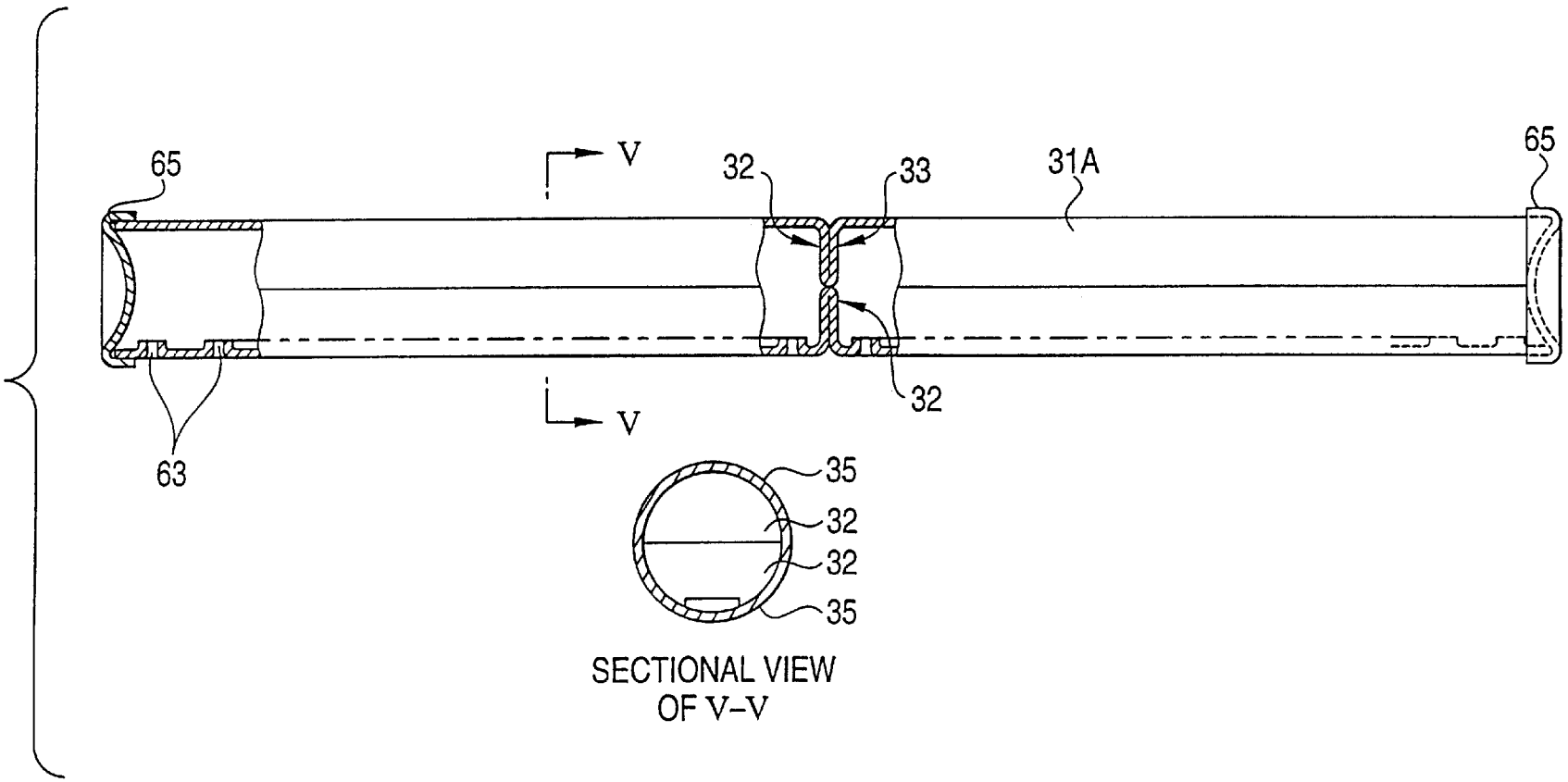
FIG. 46 PRIOR ART
FIG. 46 is a side view of a header pipe with a partition which is manufactured according to the conventional method and in which there are formed a plurality of tube insertion holes.
Figure 47:
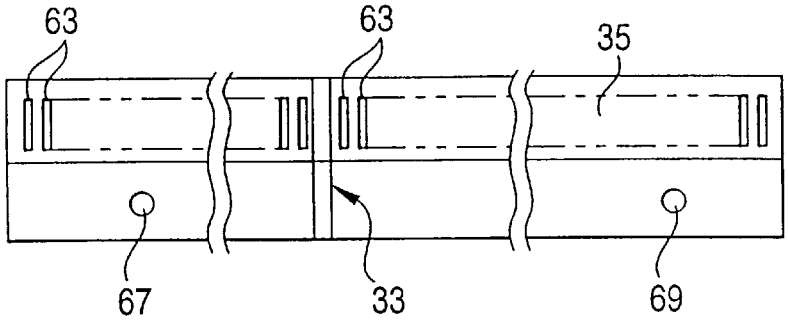
FIG. 47 PRIOR ART
FIG. 47 is an explanatory view of a tube insertion hole forming step employed in the conventional method.
Figure 48:
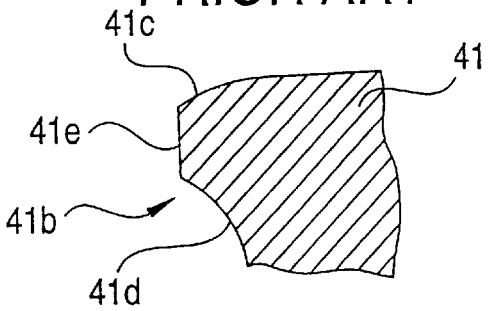
FIG. 48 PRIOR ART
FIG. 48 is an explanatory view of the section shape of the header pipe obtained in the cutting step according to the conventional.
Figure 49:
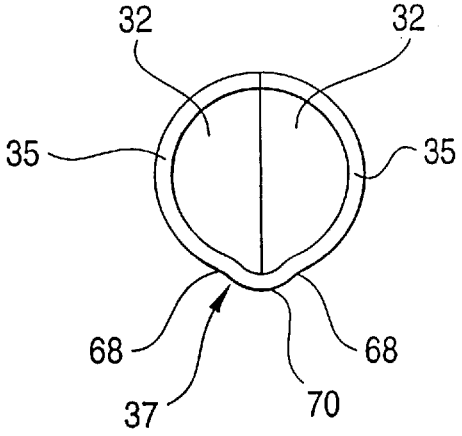
FIG. 49 PRIOR ART
FIG. 49 is an explanatory view of showing a conventional butted header pipe.
Figure 50:
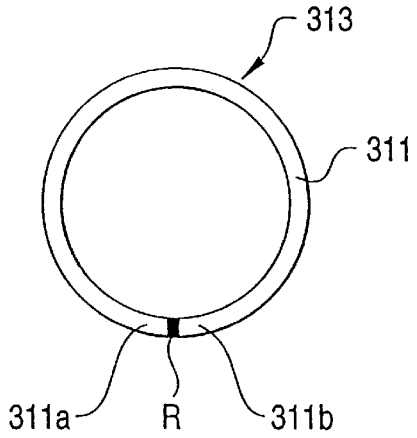
FIG. 50 PRIOR ART
FIG. 50 is an explanatory view of still another conventional pipe.
Figure 51:
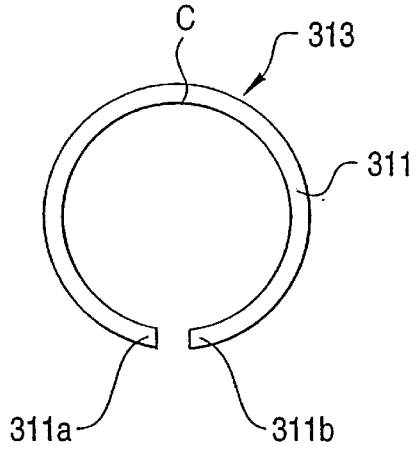
FIG. 51 PRIOR ART
FIG. 51 is an explanatory view of the conventional pipe, showing an open state thereof.
Figure 52:
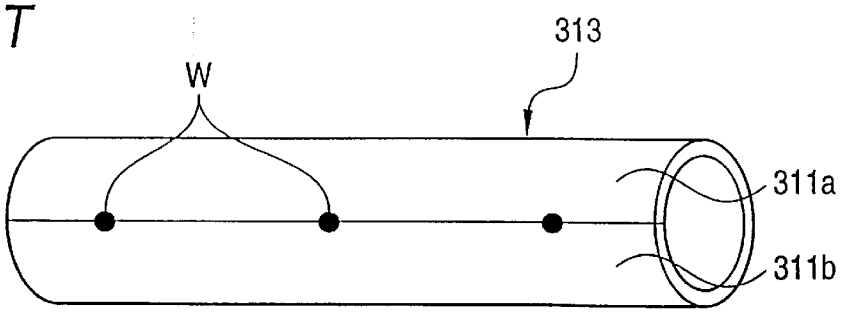
FIG. 52 PRIOR ART
FIG. 52 is an explanatory view of the conventional pipe, showing a spot welded state thereof.
Figure 53:
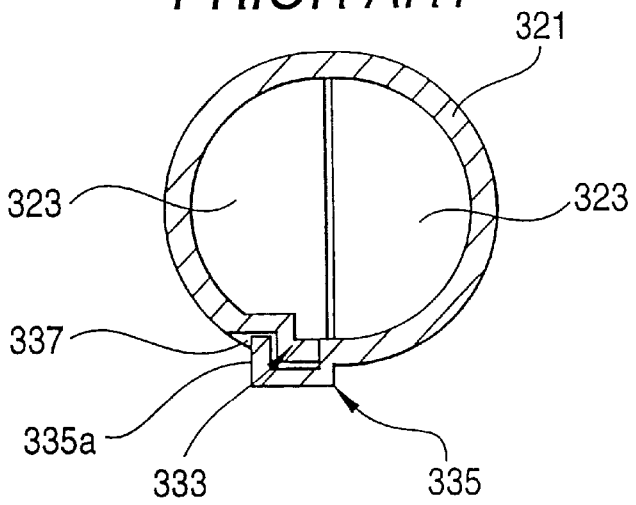
FIG. 53 PRIOR ART
FIG. 53 is a sectional view of a fitting portion of the conventional pipe.
Figure 54:
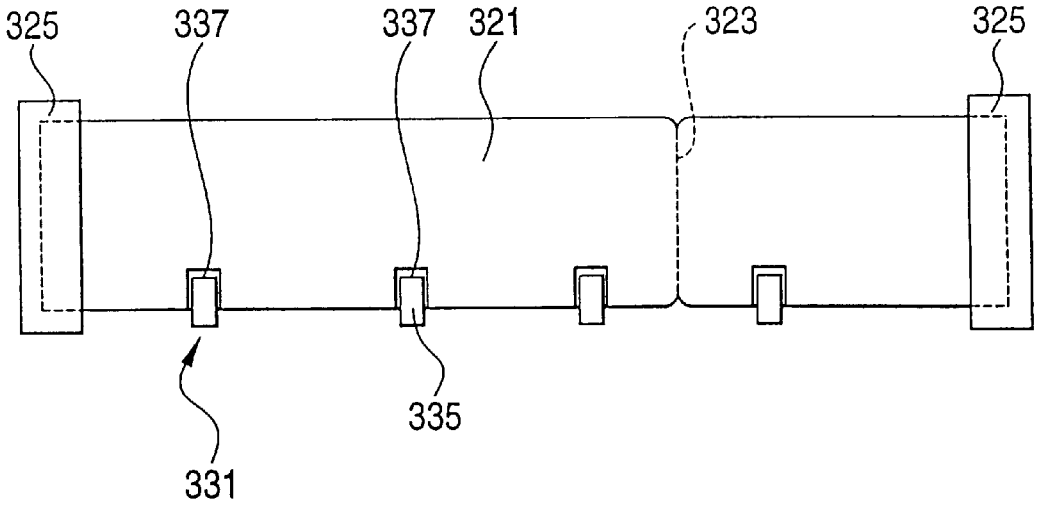
FIG. 54 PRIOR ART
FIG. 54 is a side view of the conventional pipe shown in FIG. 53.
Figure 55:
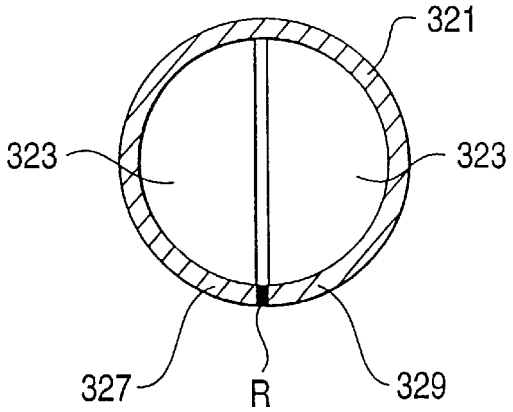
FIG. 55 PRIOR ART
FIG. 55 is a sectional view of the other portions of the conventional pipe shown in FIG. 53 than the fitting portion thereof.
Figure 56:
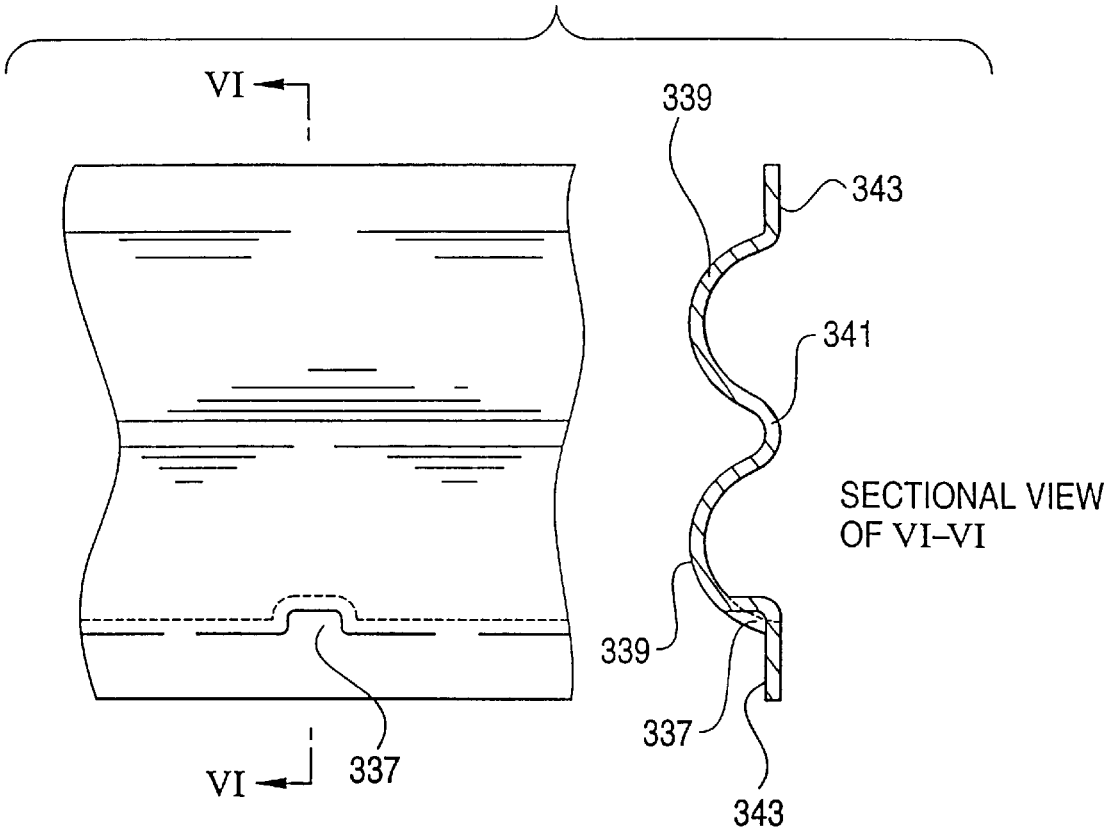
FIG. 56 PRIOR ART
FIG. 56 is an explanatory view of a molding step employed in a conventional pipe manufacturing method.
Figure 57:
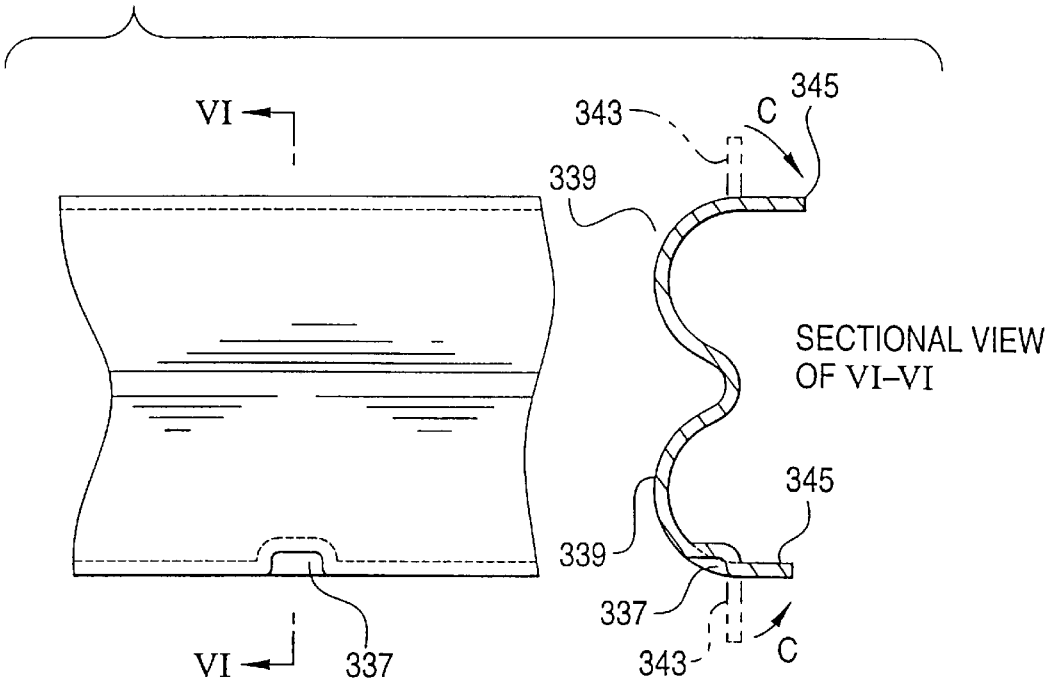
FIG. 57 PRIOR ART
FIG. 57 is an explanatory view of a bending step employed in the conventional pipe manufacturing method.
Figure 58:
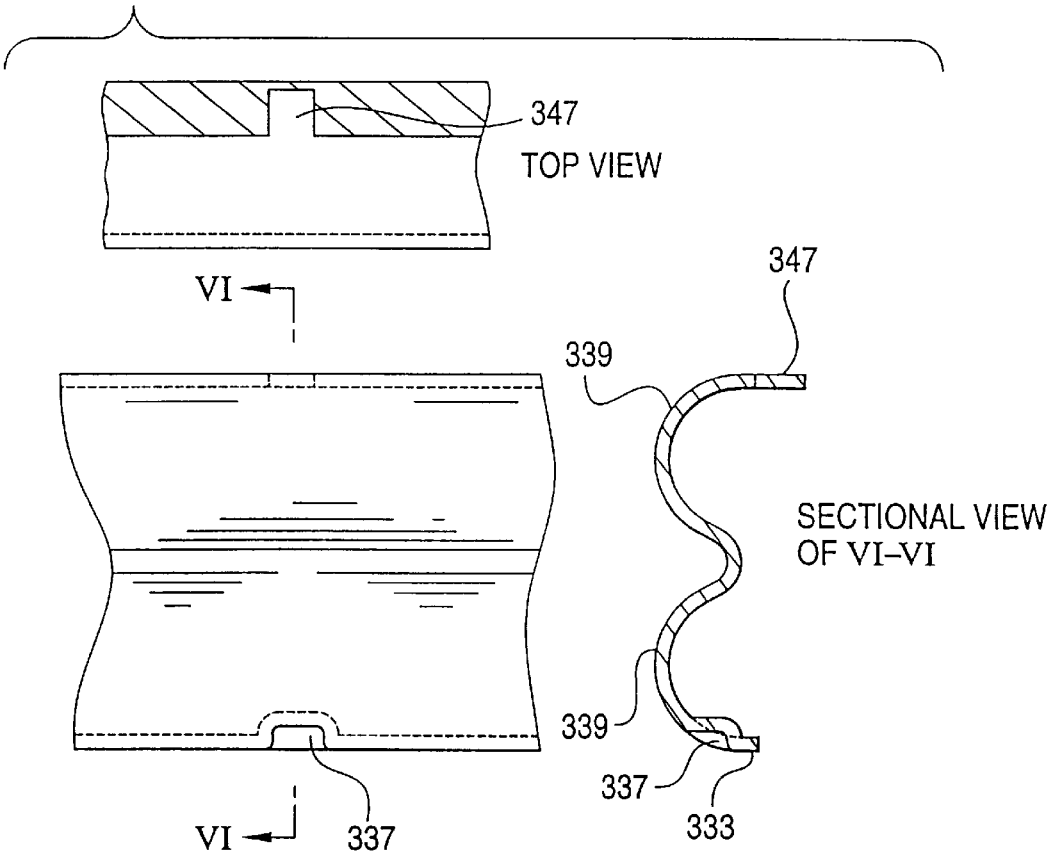
FIG. 58 PRIOR ART
FIG. 58 is an explanatory view of a cutting step employed in the conventional pipe manufacturing method.
Figure 59:
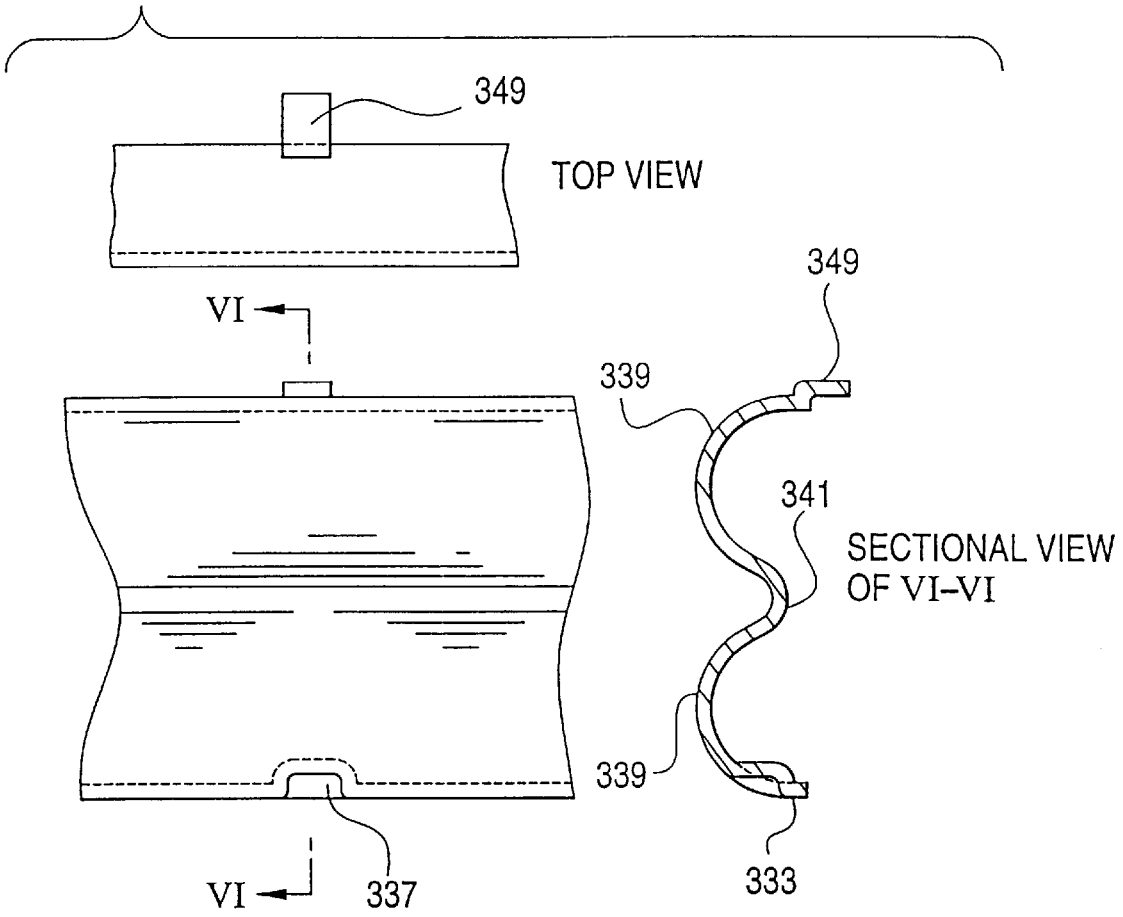
FIG. 59 PRIOR ART
FIG. 59 is an explanatory view of a caulking pawl portion molding step employed in a conventional pipe manufacturing method.
Figure 60:
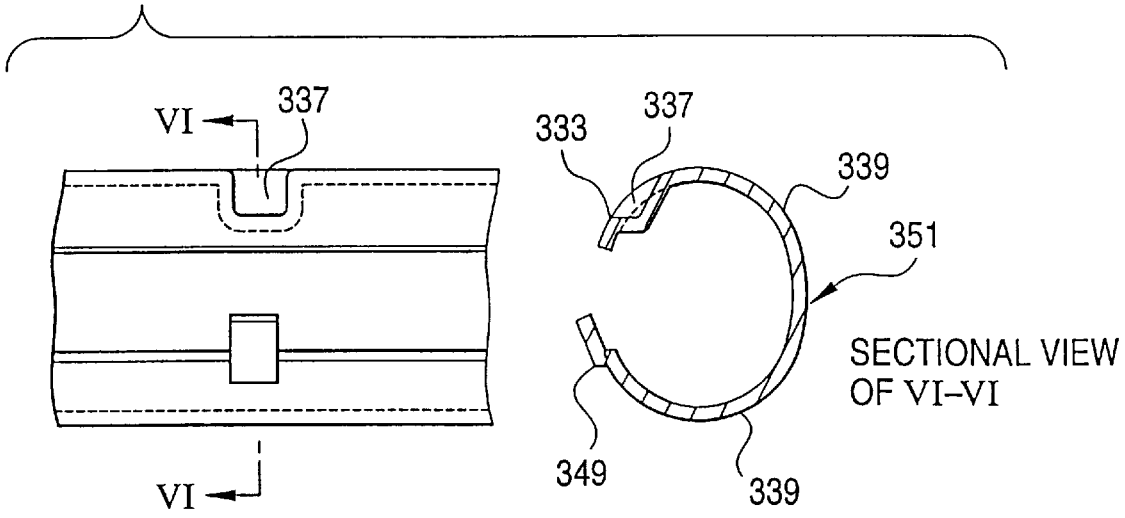
FIG. 60 PRIOR ART
FIG. 60 is an explanatory view of a mutually opposing step employed in the conventional pipe manufacturing method.
Figure 61:
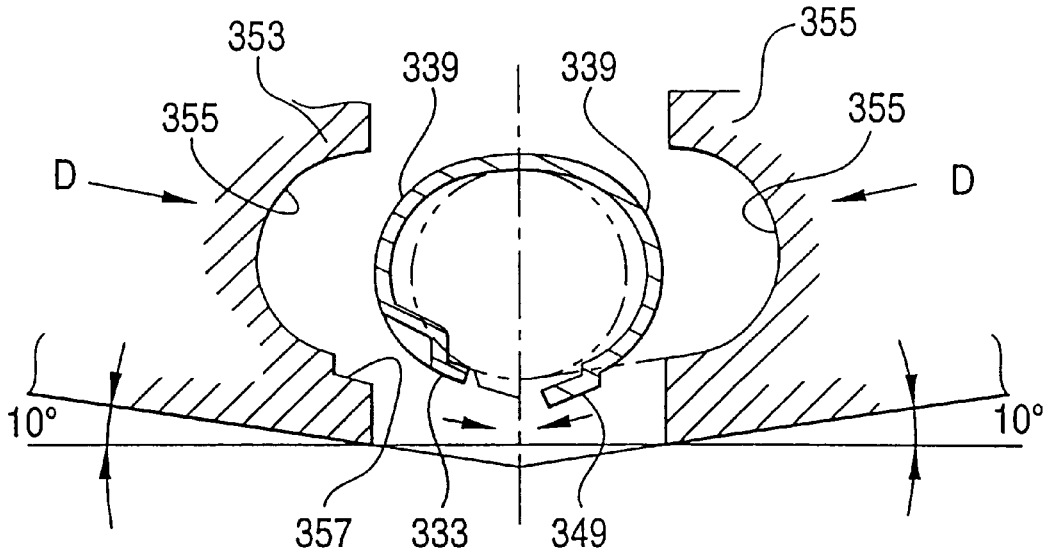
FIG. 61 PRIOR ART
FIG. 61 is an explanatory view of a curling step employed in the conventional pipe manufacturing method.
Figure 62:
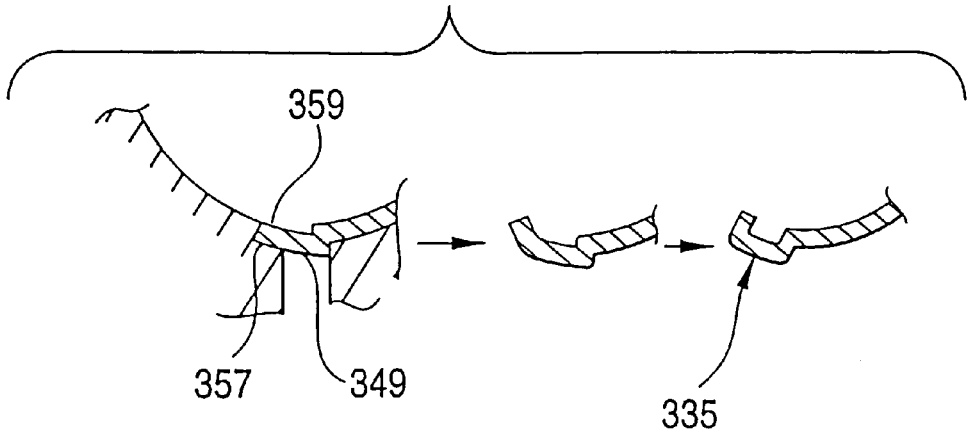
FIG. 62 PRIOR ART
FIG. 62 is an explanatory view of the conventional pipe manufacturing method, showing a state thereof in which a caulking pawl portion is bent in the curling step shown in FIG. 61.

Next, according to a butting step shown in FIG. 35, the pair of mutually opposed semidivided cylindrical portions 101 are butted against each other.

And, in the present embodiment, the butting of the pair of mutually opposed semidivided cylindrical portions 101 is executed by the previously described embodiments shown in FIGS. 8 to 10, or 19 to 21, 23. That is, when the butting is executed by the apparatus shown in FIGS. 8 or 10, the connecting portion 103 is always pressed with a given pressure by the coil spring 179 through the lifter 171 the working properties of the connecting portion 103 in the molding operation are prevented from being revived. And when the butting is executed by the apparatus shown in FIG. 19, the butting is executed by securing the pressing portions formed in the metal mold to the pressing recessed portions 115 formed in the header pipe main body.

After then, according to a caulking step (which is not shown), the caulking pawl portions 117 are respectively caulked and fixed to the securing recessed portions 113 and, in this state, a connecting step is carried out; that is, not only the pair of semidivided cylindrical portions 101 but also the pair of semidivided partition portions 109 are connected to each other.

By the way, in the present embodiment, the connecting step is executed by performing a brazing operation using non-corrosive flux.

In the header pipe with a partition manufactured in the above-mentioned manner, since the end faces of the edge portions of the flat plate respectively cut into a given shape in the trimming operation are then face-struck into a linear shape and the mutually butted portions of the pair of semidivided cylindrical portions are thereby formed into a linear shape, when the pair of semidivided cylindrical portions 101 are butted against each other, the butted portions thereof are opposed to each other with a slight distance between them, with the result that the butted portions of the pair of semidivided cylindrical portions 101 can be brazed to each other with a high strength without increasing the thickness of the flat plate used as a blank material.

Further, while the pressing portions formed in the metal molds are being secured to the pressing recessed portions 115 formed in the neighborhood of one side edge portion and the other side edge portion of a pipe main body, the metal molds are moved to thereby press against one side edge portion and the other side edge portion in their mutually opposing directions, so that one side edge portion and the other side edge portion are connected to each other. Thanks to this, the neighboring portions of one side edge portion and the other side edge portion of the pipe main body can be pressed more positively by the pressing portions of the metal molds and, at the same time, even when the caulking pawl portions are formed, one side edge portion and the other side edge portion can be positively connected to each other.

As has been described heretofore in detail, according to a method for manufacturing a header pipe, the end faces of the edge portions of the flat plate respectively cut into a given shape by trimming are then respectively worked into a linear shape by face-striking, so that the mutually butted portions of the pair of semidivided cylindrical portions are formed into a linear shape. Due to this, when the pair of semidivided cylindrical portions are butted against each other, the butted portions thereof are opposed to each other with a slight distance between them, with the result that the butted portions of the pair of semidivided cylindrical portions can be brazed to each other with a high strength without increasing the thickness of the flat plate used as a blank material.

Further, in the trimming operation, the edge portions of the flat plate are respectively cut into a shape having a larger dimension than that of the finally required shape thereof, and the excess length portions of the edge portions are compressed when the pair of semidivided cylindrical portions are butted against each other, so that the mutually butted portions can be contacted together substantially in a linear shape. This also makes it possible to braze together the butted portions of the pair of semidivided cylindrical portions with a high strength without increasing the thickness of the flat plate used as a blank material.

Further, as has been described heretofore, according to an apparatus for manufacturing a header pipe, since the connecting portion situated between the pair of semidivided cylindrical portions is always pressed with a given pressure by the energizing means through the lifter, the working properties of the connecting portion in the molding operation thereof are prevented from being revived, so that the pair of semidivided cylindrical portions disposed on the two sides of the connecting portion and opposed to each other at a given angle interval can be butt worked into a cylindrically-shaped header pipe with accuracy.

Also, because there is disposed the lifter pressing lever which can be rotated together with the punches to press against the lifter, the pressing force to be applied to the connecting portion can be restricted, thereby being able to increase the energizing force of the energizing means.

Further, since the movement of the lifter can be stopped at the lower dead point of the pressing means by the stopper means, the rotation of the punches can be surely stopped at the lower dead point, which makes it possible to surely prevent the butted portions of the pair of semidivided cylindrical portions from being deformed due to the further rotation of the punches exceeding the dead point.

Still further, according to a method for manufacturing header pipe, due to the fact that, while the pressing portions respectively formed in the metal molds are being secured to the pressing recessed portions respectively formed in the neighborhood of one side edge portion and the other side edge portion of the header pipe main body, the metal molds are moved to press against one side edge portion and the other side edge portion in their mutually opposing directions to thereby connect them together, the neighboring portions of one side edge portion and the other side edge portion of the header pipe main body can be pressed more positively by the pressing portions of the metal molds and, at the same time, even when the caulking pawl portion is formed, one side edge portion and the other side edge portion can be positively connected to each other.

What is claimed is:

1. A method for manufacturing a header pipe, comprising the steps of:

molding a flat plate so that a pair of semidivided cylindrical portions are formed in parallel to each other with a connecting portion therebetween, and edge portions thereon, said edge portions having respective end faces;

cutting said edge portions of said flat plate respectively into a given shape molding said edge portions so as to erect said edge portions;

face-striking said end faces of said edge portions of said flat plate by punches, respectively, so as to work said edge portions into a linear shape;

projecting said connecting portion so as to dispose said pair of semidivided cylindrical portions being opposed to each other; and butting said pair of mutually opposed semidivided cylindrical portions against each other to thereby manufacture a cylindrically-shaped header pipe.

2. A method for manufacturing a header pipe, comprising the steps of:

molding a flat plate so that a pair of semidivided cylindrical portions are formed in parallel to each other with a connecting portion therebetween, and edge portions thereon, said edge portions having respective end faces;

cutting said edge portions of said flat plate respectively into a given shape molding said edge portions so as to erect said edge portions;

face-striking said end faces of said edge portions of said flat plate by punches, respectively, so as to work said edge portions into a linear shape;

projecting said connecting portion so as to dispose said pair of semidivided cylindrical portions being opposed to each other; and butting said pair of mutually opposed semidivided cylindrical portions against each other while pressing said connecting portion to thereby manufacture a cylindrically-shaped header pipe.

3. The method for manufacturing a header pipe according to claim 1, wherein said face-striking step is performed after said cutting step.

* * * * *